US009855788B2

(12) United States Patent
Sato et al.

(10) Patent No.: US 9,855,788 B2
(45) Date of Patent: Jan. 2, 2018

(54) EXTENDED DIVIDERS

(71) Applicant: CCL Label, Inc., Framingham, MA (US)

(72) Inventors: Jay K. Sato, Mission Viejo, CA (US); Sriram Venkatasanthanam, Chino Hills, CA (US)

(73) Assignee: CCL Label, Inc., Framingham, MA (US)

( * ) Notice: Subject to any disclaimer, the term of this patent is extended or adjusted under 35 U.S.C. 154(b) by 0 days.

(21) Appl. No.: 14/918,755

(22) Filed: Oct. 21, 2015

(65) Prior Publication Data

US 2016/0107475 A1 Apr. 21, 2016

Related U.S. Application Data

(60) Provisional application No. 62/066,697, filed on Oct. 21, 2014.

(51) Int. Cl.
*B42F 21/00* (2006.01)
*B42F 21/02* (2006.01)
*B42F 3/00* (2006.01)

(52) U.S. Cl.
CPC ..... *B42F 21/02* (2013.01); *B42F 3/003* (2013.01); *B42F 21/00* (2013.01); *B42F 21/025* (2013.01)

(58) Field of Classification Search
CPC ..... B42F 21/00; B42F 3/003; B42F 21/02; B42F 21/025
USPC ..... 402/79
See application file for complete search history.

(56) References Cited

U.S. PATENT DOCUMENTS

| | | | | |
|---|---|---|---|---|
| 356,334 | A | 1/1887 | Rosewater | |
| D272,161 | S * | 1/1984 | Lodge | D19/33 |
| 4,863,194 | A * | 9/1989 | Friedman | B42F 21/00 283/38 |
| 5,299,879 | A | 4/1994 | Burrow | |
| 5,503,435 | A | 4/1996 | Kline | |
| 5,908,259 | A * | 6/1999 | Johnson | B42F 21/02 402/79 |
| 6,511,246 | B2 | 1/2003 | Sapienza et al. | |
| 6,752,428 | B2 | 6/2004 | Sapienza et al. | |
| 6,752,559 | B2 | 6/2004 | Sapienza et al. | |
| 6,758,498 | B2 | 7/2004 | Sapienza et al. | |
| 6,974,274 | B2 | 12/2005 | Sapienza et al. | |
| 7,905,672 | B2 * | 3/2011 | Busam | B24B 45/00 402/73 |
| 2002/0102125 | A1 * | 8/2002 | Sapienza | B42F 21/02 402/79 |

FOREIGN PATENT DOCUMENTS

| | | | | |
|---|---|---|---|---|
| FR | 2783457 A1 * | 3/2000 | | B42F 21/00 |
| WO | WO 0204228 A1 * | 1/2002 | | B42F 21/00 |

* cited by examiner

*Primary Examiner* — Kyle Grabowski
(74) *Attorney, Agent, or Firm* — McDonald Hopkins LLC

(57) ABSTRACT

A divider assembly is shown and described herein. A divider assembly for dividing a stack of sheets, the divider assembly may include a sleeve having a first edge and an opposite second edge. A label display element inserted into the sleeve having at least one label indicia generally aligned along the first edge of the sleeve. At least one divider may include a first edge and an opposite second edge and a tab extending from the first edge. The tab may be extend beyond the first edge of the sleeve such that a user may view the at least one label indicia at a position adjacent and inward relative to the tabs.

6 Claims, 17 Drawing Sheets

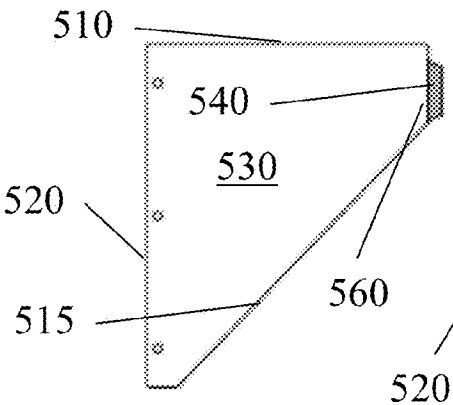
FIG. 5A
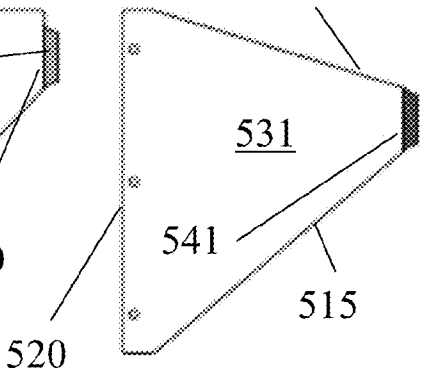
FIG. 5B
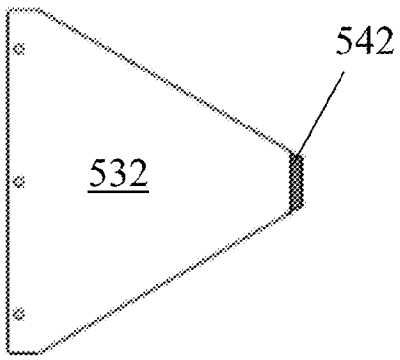
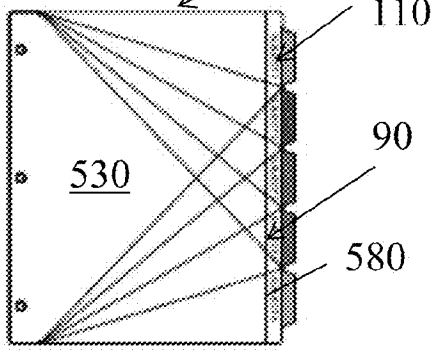
FIG. 5C
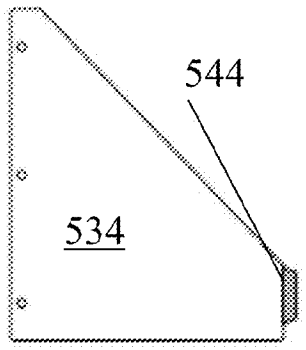
FIG. 5E
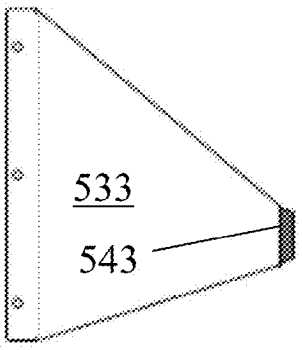
FIG. 5D
FIG. 5F

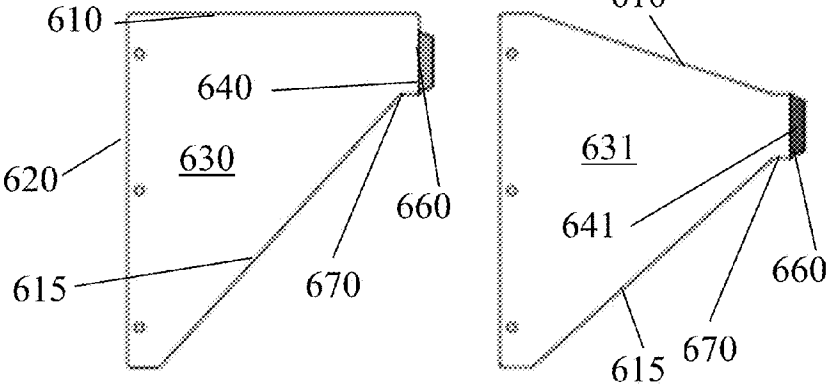
FIG. 6A
FIG. 6B
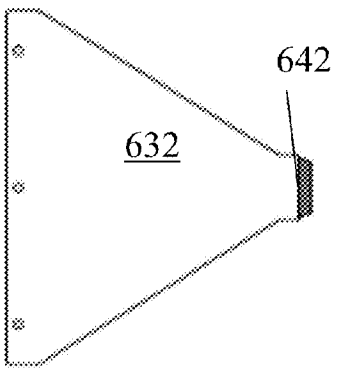
FIG. 6C
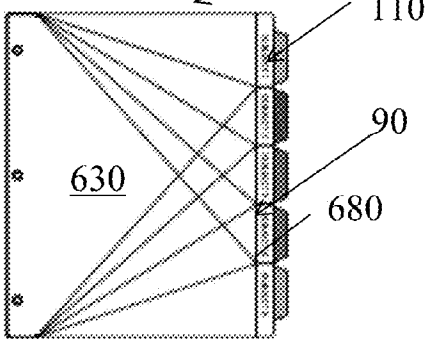
FIG. 6D
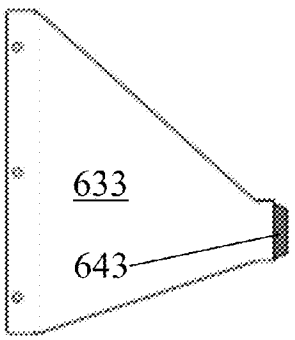
FIG. 6E
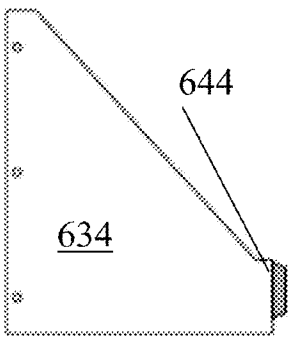
FIG. 6F

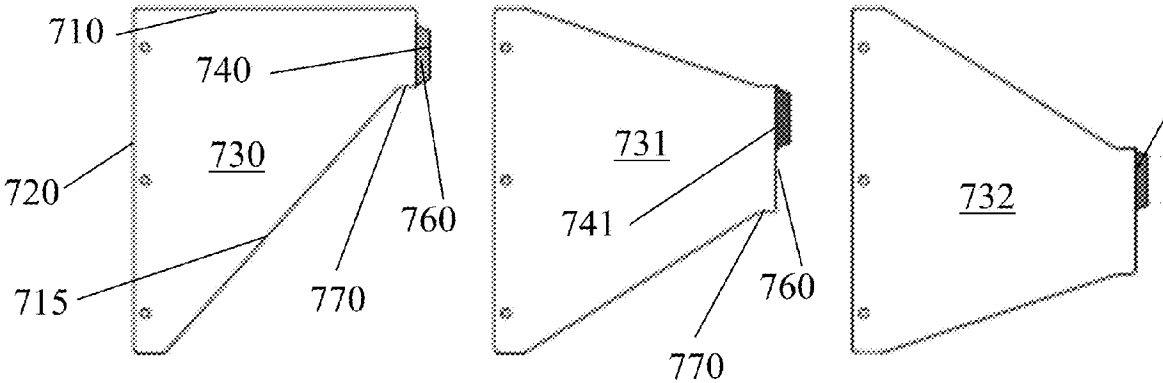
FIG. 7A
FIG. 7B
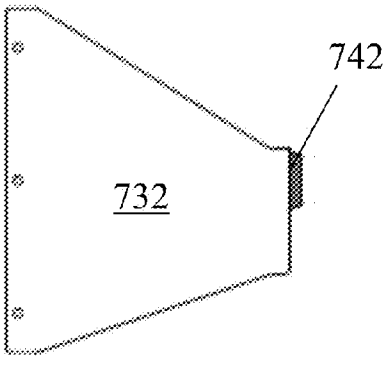
FIG. 7C
FIG. 7D
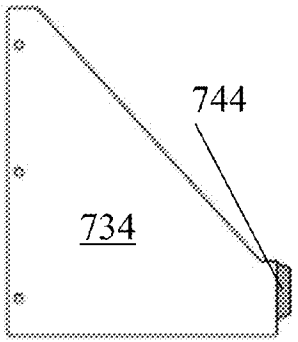
FIG. 7E
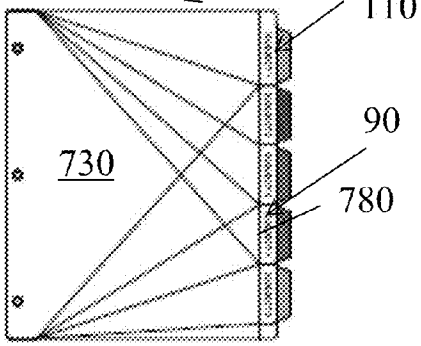
FIG. 7F

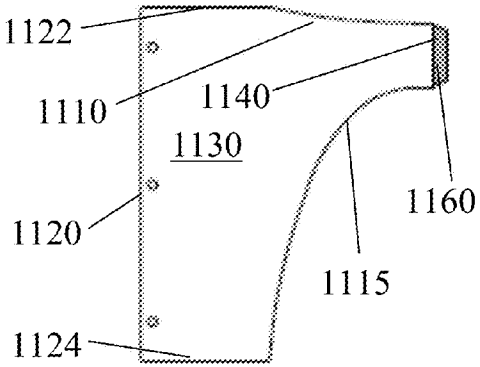
FIG. 11A
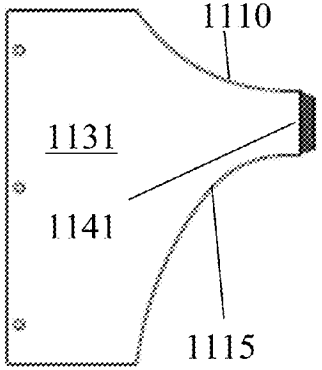
FIG. 11B
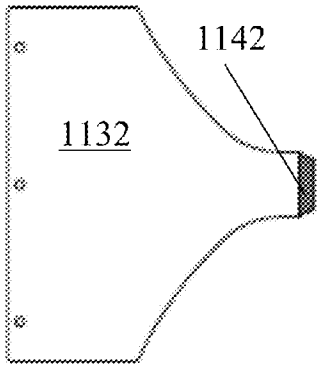
FIG. 11C
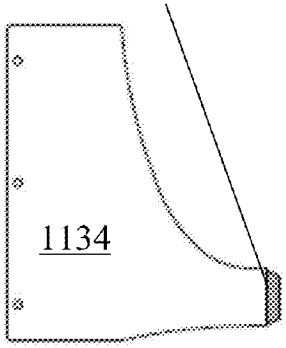
FIG. 11D
FIG. 11E
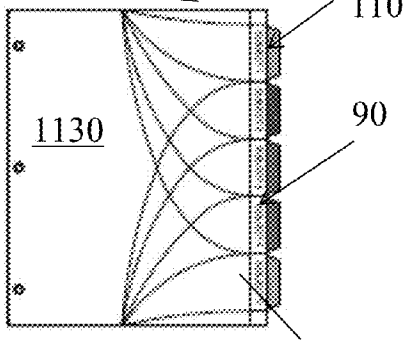
FIG. 11F

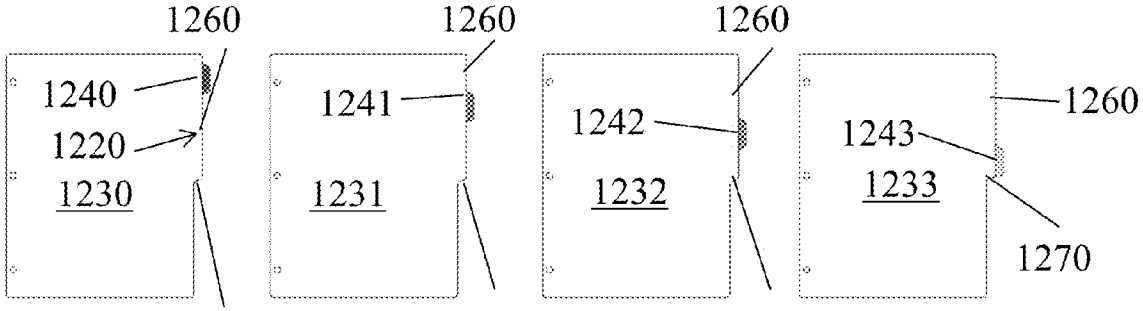
FIG. 12A
FIG. 12B
FIG. 12C
FIG. 12D
FIG. 12E
FIG. 12F
FIG. 12G
FIG. 12H
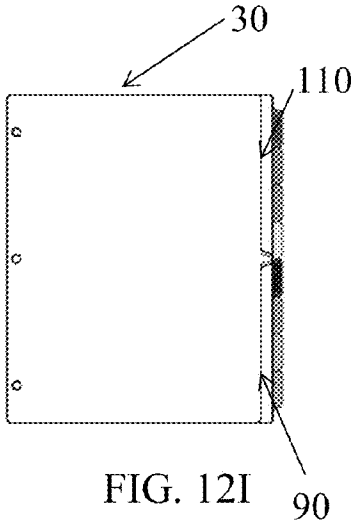
FIG. 12I

EXTENDED DIVIDERS

CROSS-REFERENCE TO RELATED APPLICATIONS

This application claims priority to U.S. provisional patent application No. 62/066,697 filed on Oct. 21, 2014 titled EXTENDED DIVIDERS which is incorporated herein by reference in its entirety.

FIELD OF INVENTION

The present disclosure generally relates to a system for organizing and indexing documents wherein the systems include index dividers or tabbed dividers that are locatable adjacent to label indicia on a display element. More particularly, the disclosure relates to a system of dividers with see-through body sections for placement over indicia identifying the divider.

BACKGROUND

Dividers for organizing sheets of paper or display elements generally include tabs that extend beyond the perimeter of the paper. The tabs generally include label indicia thereon to identify the divided section of the sheets of paper or display elements. Other tabs have been known to be formed out of generally clear or semi-transparent material and formed into pockets to insert a label having indicia thereon. Other known dividers have tabs made of clear or transparent material that include labels that may be attached by a pressure sensitive adhesive directly to the tab.

Dividers are often utilized in binders such as three ring binders or spiral binders and other types of folders or media assemblies. The dividers separate and visually label various sections of the sheets of paper or display elements to permit prompt access to any one of these sections.

Sapienza et al. U.S. Pat. No. 6,758,498 discloses an indexing package and display system with a label portion disposed in a viewing position that is configured for displaying label indicia thereon for identifying one of a plurality of divided sections. The viewing position of the label is directly aligned under tabs that are generally transparent. U.S. Pat. No. 5,503,435 to Kline discloses an index divider and table of contents page that is customizable with a sheet that includes labels having adhesives to be pealed and placed on a plurality of divider tabs.

However, many known divider systems have inherent deficiencies. For example, there may be a limited area for customizable descriptors on the divider tabs. Further, labels designed to be adhered to the tabs are not easily removed from the tabs. Additionally, many divider systems offer limited range of customizable features.

Therefore, there is a need for expanding the space available for indicia or descriptors associated with a divider tab to allow for greater customization. There is also a need for an improved divider system that reduces the steps necessary to label or to re-label descriptors associated with divider tabs.

SUMMARY

A divider system as shown and described herein. Disclosed is a divider assembly for dividing a stack of sheets, the divider assembly may include a sleeve having a first edge and an opposite second edge. A label display element configured to be inserted into the sleeve having at least one label indicia generally aligned along the first edge of the sleeve. At least one divider may include a first edge and an opposite second edge and a tab extending from the first edge. The tab may be configured to extend beyond the first edge of the sleeve such that a user may view the at least one label indicia through the divider at a position generally inwardly and adjacent to the tab.

The sleeve may be made of a generally see-through material. The sleeve may include at least one window aperture aligned along the first edge, the window aperture configured to align with the at least one label indicia. The divider assembly may include at least five divider sheets and the label display element may include five label indicia. However, the present teachings contemplate any number of divider sheets and indicia configured to align with the tabs of the dividers. The tabs of the dividers may be aligned with the at least one label indicia within the sleeve. The divider may be made of a generally see-through material. The sleeve may include a plurality of apertures to be selectively attached to a binder. The label display element may be a sheet of paper.

In one embodiment, provided is a divider assembly for dividing a stack of sheets, the divider assembly includes a sleeve having a first edge and an opposite second edge. A label display element may be configured to be inserted into the sleeve having at least one label indicia generally aligned along the first edge of the sleeve. At least one divider having a first edge and an opposite second edge and a tab extending from the first edge. The label display element may be configured to extend beyond the tabs of the divider such that a user can view the at least one label indicia. The sleeve may be made of a generally see-through material. The tab of the divider may be aligned with the at least one label indicia within the sleeve.

In another embodiment, provided is a divider assembly for dividing a stack of sheets, the divider assembly including a label display element that includes at least one label indicia. At least one divider sheet having a first edge and an opposite second edge and a tab extending from the first edge. The tab may be configured to extend beyond the at least one label indicia of the label display element such that a user can view the at least one label indicia through a viewable portion of the at least one divider. A sleeve having a first edge and an opposite second edge wherein the label display element may be configured to be inserted into the sleeve and the at least one label indicia may be aligned along the first edge. The at least one divider may include at least one window aperture aligned along the first edge, the window aperture configured to align with the at least one label indicia. The divider may include a body having a first side and a second side that extend between a base portion and a perimeter edge such that the tab aligns with the associated indicia within the viewable portion of the divider. The first side and the second side of the divider may each extend from the base portion in relatively straight and angled configurations relative to the tab that is aligned and vertically offset to a subsequent tab. The divider may include a lateral portion that extends a length that is greater than a length of the tabs along the perimeter edge of the divider. The first side and second side of the divider may include a generally curved orientation as they extend between the base portion and the perimeter edge.

BRIEF DESCRIPTION OF THE DRAWINGS

Operation of the invention may be better understood by reference to the following detailed description taken in connection with the following illustrations, wherein:

FIG. 5A is a plan view of a divider of a divider set in accordance with an embodiment of the present disclosure;

FIG. 5B is a plan view of a divider of the divider set of the present disclosure;

FIG. 5C is a plan view of a divider of the divider set of the present disclosure;

FIG. 5D is a plan view of a divider of the divider set of the present disclosure;

FIG. 5E is a plan view of a divider of the divider set of the present disclosure;

FIG. 5F is a plan view of an embodiment of the divider set of FIGS. 5A-5E in accordance with one aspect of the present disclosure;

FIG. 6A is a plan view of a divider of a divider set in accordance with an embodiment of the present disclosure;

FIG. 6B is a plan view of a divider of the divider set of the present disclosure;

FIG. 6C is a plan view of a divider of the divider set of the present disclosure;

FIG. 6D is a plan view of a divider of the divider set of the present disclosure;

FIG. 6E is a plan view of a divider of the divider set of the present disclosure;

FIG. 6F is a plan view of an embodiment of the divider set of FIGS. 6A-6E in accordance with one aspect of the present disclosure;

FIG. 7A is a plan view of a divider of a divider set in accordance with an embodiment of the present disclosure;

FIG. 7B is a plan view of a divider of the divider set of the present disclosure;

FIG. 7C is a plan view of a divider of the divider set of the present disclosure;

FIG. 7D is a plan view of a divider of the divider set of the present disclosure;

FIG. 7E is a plan view of a divider of the divider set of the present disclosure;

FIG. 7F is a plan view of an embodiment of the divider set of FIGS. 7A-7E in accordance with one aspect of the present disclosure;

FIG. 11A is a plan view of a divider of a divider set in accordance with an embodiment of the present disclosure;

FIG. 11B is a plan view of a divider of the divider set of the present disclosure;

FIG. 11C is a plan view of a divider of the divider set of the present disclosure;

FIG. 11D is a plan view of a divider of the divider set of the present disclosure;

FIG. 11E is a plan view of a divider of the divider set of the present disclosure;

FIG. 11F is a plan view of an embodiment of the divider set of FIGS. 11A-11E in accordance with one aspect of the present disclosure;

FIG. 12A is a plan view of a divider of a divider set in accordance with an embodiment of the present disclosure;

FIG. 12B is a plan view of a divider of the divider set of the present disclosure;

FIG. 12C is a plan view of a divider of the divider set of the present disclosure;

FIG. 12D is a plan view of a divider of the divider set of the present disclosure;

FIG. 12E is a plan view of a divider of the divider set of the present disclosure;

FIG. 12F is a plan view of a divider of the divider set of the present disclosure;

FIG. 12G is a plan view of a divider of the divider set of the present disclosure;

FIG. 12H is a plan view of a divider of the divider set of the present disclosure;

FIG. 12I is a plan view of an embodiment of the divider set of FIGS. 12A-12H in accordance with one aspect of the present disclosure;

FIG. 13D is a plan view of an embodiment of the divider set of FIGS. 13B and 13C in accordance with one aspect of the present disclosure.

DETAILED DESCRIPTION

Figures 1A, 1B, 1C, 1D, 1E:
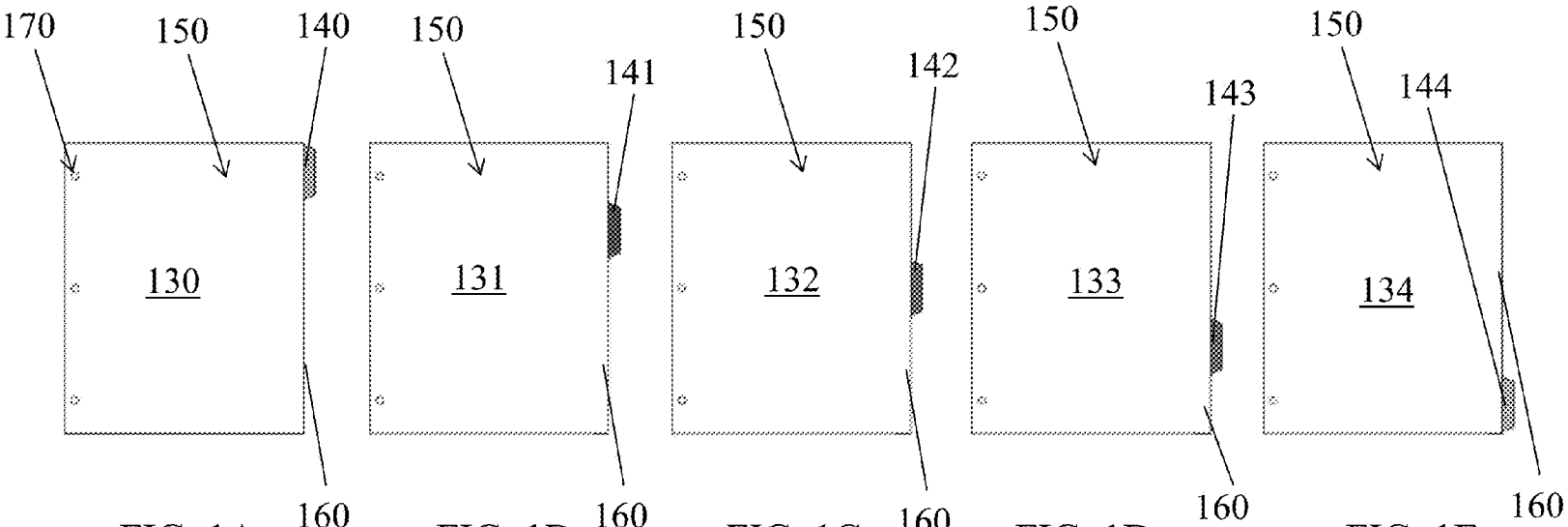
FIG. 1A is a plan view of a divider of a divider set of the present disclosure.
FIG. 1B is a plan view of a divider of the divider set of the present disclosure.
FIG. 1C is a plan view of a divider of the divider set of the present disclosure.
FIG. 1D is a plan view of a divider of the divider set of the present disclosure.
FIG. 1E is a plan view of a divider of the divider set of the present disclosure.

Reference will now be made in detail to embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

A divider system 20 is disclosed and may be of any appropriate configuration and is not limited to that shown and described herein. It should similarly be understood that the divider system 20 may be adapted to divide a plurality of sheets or other display elements of any appropriate size, including, without limitation, 8.5 inches by 11 inches, A4 size, legal size or any other applicable size. The divider system 20 may be configured to be utilized with a binder of any appropriate size and construction.

The divider system 20 may include a label display element. The label display element may include a sheet 10 configured to be inserted into a sleeve 30 as illustrated by FIGS. 1F, 1G, 1H, 2F, 2G, 2H, 3F, 3G, 3H, 4F, 5F, 6F, 7F, 8F, 9I, 10F, 11F, 12I, and 13D. The sleeve 30 may be made of any appropriate material, including, without limitation a plastic or polymer material such as a polypropylene material or other transparent, translucent or semi-translucent material. As way of a further embodiment, the sleeve 30 may also be formed from a monolithic plastic piece. The sleeve 30 may be shaped to include a pocket 40 to hold a label sheet 10 or other items (such as writing instruments, rulers, paper clips, etc.). It should be understood that the sleeve 30 may be of any appropriate construction and is not limited to that shown and described herein. The sleeve 30 may also include a first edge 50 opposite a second edge 60 and a top edge 70 opposite a bottom edge 80. The respective edges 50, 60, 70, 80 define a perimeter of the sleeve 30. It should be understood that the label display element may also include the sheet 10 with indicia thereon within a viewable portion without the sleeve 30 and include various configurations as described.

The sleeve 30 may include a viewable portion 90 and a base portion 100. The viewable portion 90 may extend along the first edge 50 and be configured such that indicia 110 on the label sheet 10 may be aligned with the viewable portion 90 of the sleeve 30. The indicia 110 may be printed on the label sheet 10 and inserted within the pocket 40 of the sleeve 30. The indicia 110 may be configured to align along the first edge 50 of the sleeve 30 when the label sheet 10 is inserted into the sleeve 30. The indicia 110 may be printed directly on the sleeve 30.

The sleeve 30 may be shaped to maintain the indicia 110 of the label sheet 10 aligned within the viewable portion 90 of the sleeve 30. In the present disclosure, five (5) separate indicia 110*a*, 110*b*, 110*c*, 110*d*, and 110*e* are illustrated by the Figures and may be viewable along the viewable portion 90 of the sleeve 30. However, any number of indicia 110 may be provided along the viewable portion 90 of the sleeve 30 and this disclosure is not limited as to number or type. It is contemplated that a broad range of customizable indicia 110 may be viewable to the user along the viewable portion 90 of the sleeve 30.

In embodiments of the sleeve 30, the base portion 100 may include a base 100 or structural portion of the sleeve 30 wherein the structural portion extends inwardly from the second edge 60 and includes a plurality of apertures 120 thereon. The base 100 portion of the sleeve may abut against a side of the label sheet 10, opposite from the indicia 110 such that the indicia 110 may maintain its alignment adjacent the first edge 50 of the sleeve 30 and be aligned with the viewable portion 90. The base portion 100 assists to provide structural integrity to the apertures 120 of the sleeve 30 as it is attached to a binder or folder. The apertures 120 may be of any configuration and is not limited to that shown and described herein.

As illustrated by FIGS. 1A-1E, the divider system may further include at least one divider and preferably a plurality of dividers 130-134. In one embodiment, there are five (5) dividers 130-134, however this disclosure may include generally any number of dividers, e.g., two, three, four, six, seven, eight, etc. The dividers 130-134 may be generally combined with the sleeve 30 and sheet 10. Alternatively, the dividers 130-134 may be combined with just the sheet 10 having indicia thereon.

Figures 1F, 1G, 1H:
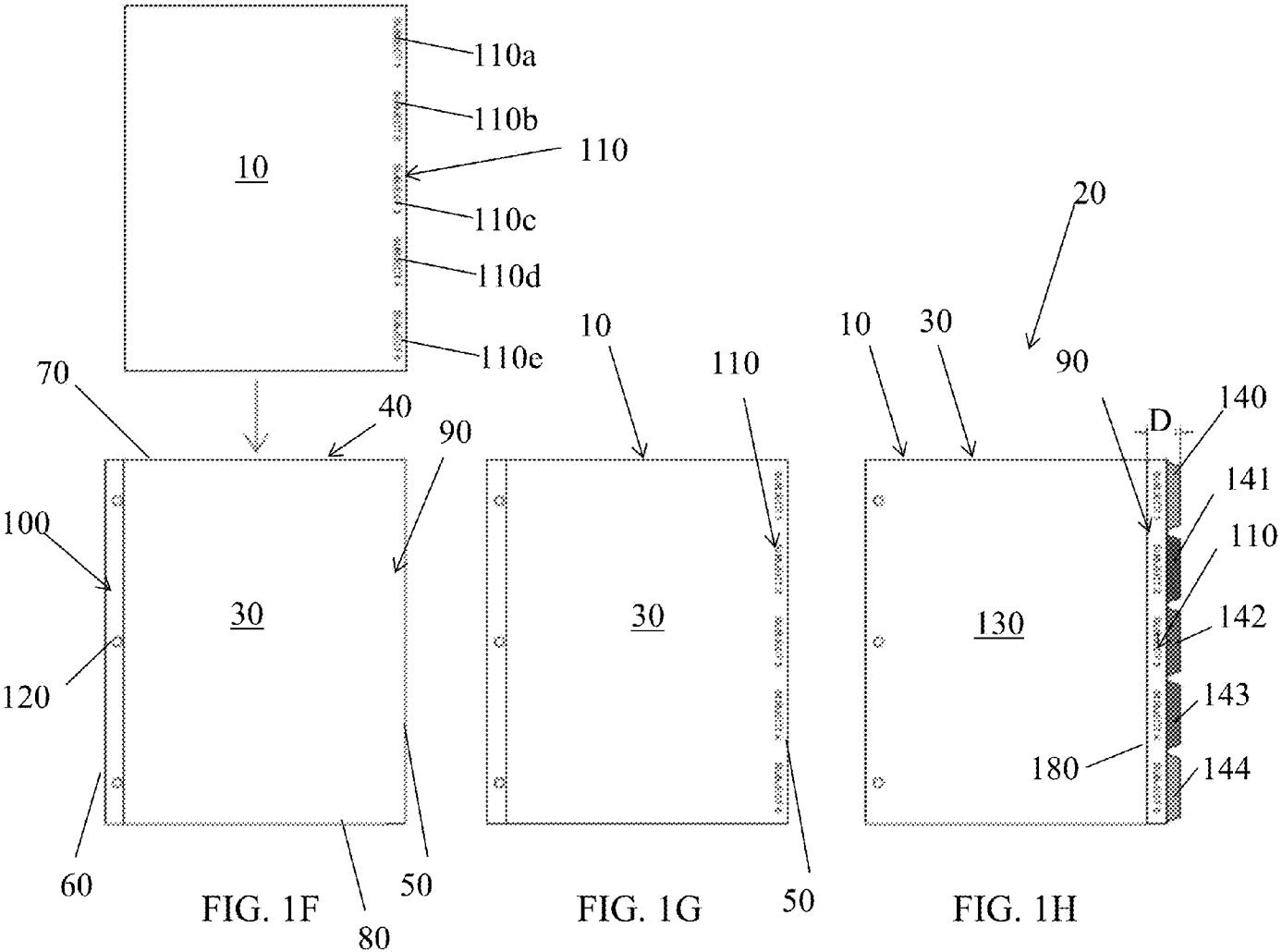
FIG. 1F is a plan view of a sleeve and a sheet of the present disclosure.
FIG. 1G is a plan view of the sheet within the sleeve of FIG. 1F.
FIG. 1H is a plan view of an embodiment of the divider set of FIGS. 1A-1F in alignment with the sheet in accordance with one aspect of the present disclosure.

The dividers 130-134 may each include a body 150 having an outwardly extending tab that extends along its perimeter. FIGS. 1A-1E illustrates five (5) tabs 140-144 associated with dividers 130-134 respectively. The tabs 140-144 may extend from a perimeter edge 160 of the body 150 of each divider 130-134 at a different position along the perimeter edge 160 such that when the dividers 130-134 are aligned, the tabs 140-144 may be vertically off-set in a known manner as illustrated by FIG. 1H for easy viewing, access and manipulation of the dividers 130-134. If many dividers are used to separate different groupings of papers in the system, and the tab of divider 130 is at the top of that body and the tab of the last divider 134 is at the bottom of that body, then a plurality of divider sets (not shown) may also be used. The body 150 of each divider may include a plurality of apertures 170 aligned along a side of the divider. The apertures 170 are positioned on the body 150 to allow the dividers 130-134 to be operably attached to a binder or folder (not shown), such as a three ring binder. The apertures 170 may be of any configuration.

The tabs 140-144 may have a generally monolithic continuous configuration with the body 150 and be formed on the body 150 of the dividers 130-134 by a die-cutting machine, or other cutting apparatus generally known in the art. Alternatively, the tabs 140-144 may be separate members from the body 150 and may be attached thereto by an adhesive or other method. The tabs 140-144 may be made of any appropriate material, including, without limitation, paper, cardboard, or a polymer material such as a polypropylene material. The tabs may be clear or opaque, colored or colorless, transparent, translucent or semi-translucent material and include various combinations of colors. The body 150 may be clear or semi-translucent material to allow the user to view the indicia 110 along the viewable portion 90 adjacent to the first edge 50 of the sleeve 30. However, the remaining portion of the body 150 of the dividers 130-134 may be clear or opaque, colored or colorless, transparent, translucent or semi-translucent material and include various combinations of colors.

As illustrated by FIG. 1H, the dividers 130-134 and the sleeve 30 may be combined for dividing various sections within the stack of dividers 130-134. Divider 130 may be positioned on the top of the divider system 20 and the sleeve 30 may be positioned at the bottom of the divider system 20 wherein the stack of papers or materials to be divided are positioned between or relative to the associated divider 130-134. In this embodiment, the perimeter edge 160 of the dividers 130-134 may be aligned with the first edge 50 of the sleeve 30 such that the indicia 110 may be positioned inwardly from the plurality of tabs 140-144. The dividers 130-134 may be generally clear or translucent along a portion of the body adjacent the perimeter edge 160 to allow a user to view the indicia 110 through the body 150 of the dividers 130-134. The indicia 110 may include various labels that are associated with and generally aligned and inwardly adjacent to the tabs 140-144. In this embodiment, the stack of papers that are divided by the dividers 130-134 also includes a perimeter edge that would align with or be the located generally inward from an indicia line 180. The indicia line 180 may be located a dimension D from a top of the plurality of tabs 140-144. In one non-limiting embodiment, the dimension D is approximately 1 inch. The indicia line 180 may be a reference line to identify the alignment of the indicia 110 relative to the sleeve 30 and tabs wherein the indicia line 180 may not necessarily be physically present on the sleeve 30, sheet 10 or label display element.

The disclosed divider system may include a plurality of configurations and an embodiment of the dividers is illustrated by FIGS. 2A-2E. In this embodiment, there are five (5) dividers 230-234, however this disclosure may include generally any number of dividers, e.g., two, three, four, six, seven, eight, etc. The dividers 230-234 may be generally combined with the sleeve 30 and sheet 10. Alternatively, the dividers 230-234 may be generally combined with a label display element or sheet 10 with indicia thereon.

Figures 2A, 2B, 2C, 2D, 2E:
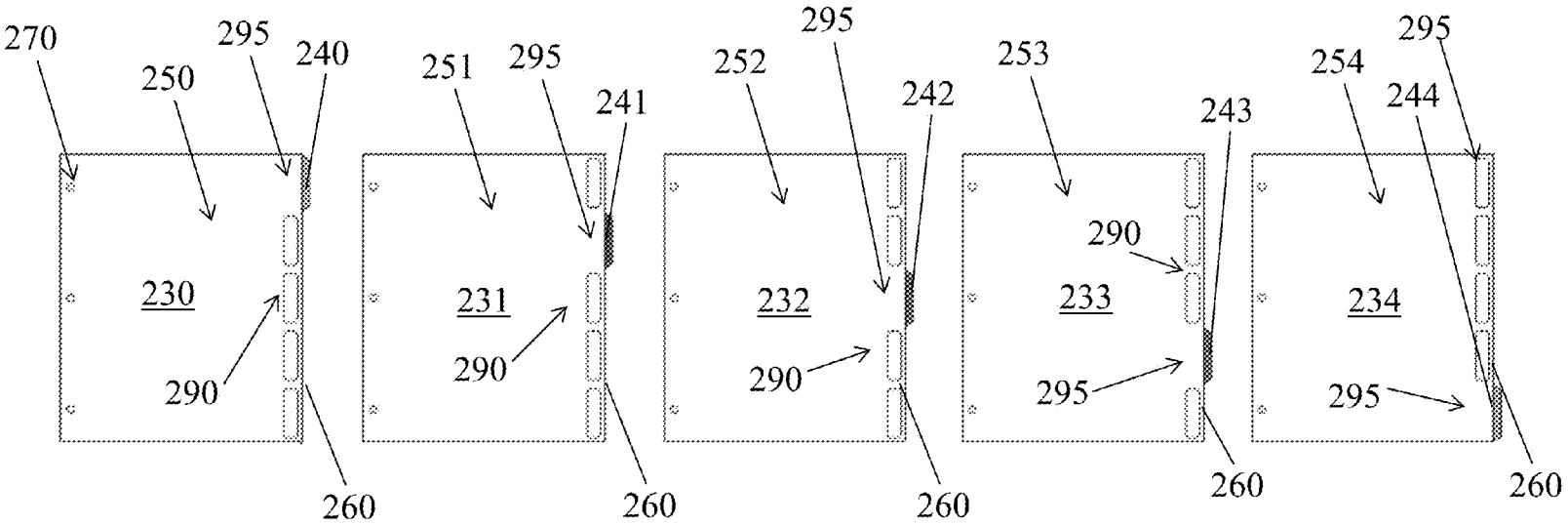
FIG. 2A is a plan view of a divider of a divider set in accordance with an embodiment of the present disclosure.
FIG. 2B is a plan view of a divider of the divider set of the present disclosure.
FIG. 2C is a plan view of a divider of the divider set of the present disclosure.
FIG. 2D is a plan view of a divider of the divider set of the present disclosure.
FIG. 2E is a plan view of a divider of the divider set of the present disclosure.
Figures 2F, 2G, 2H:
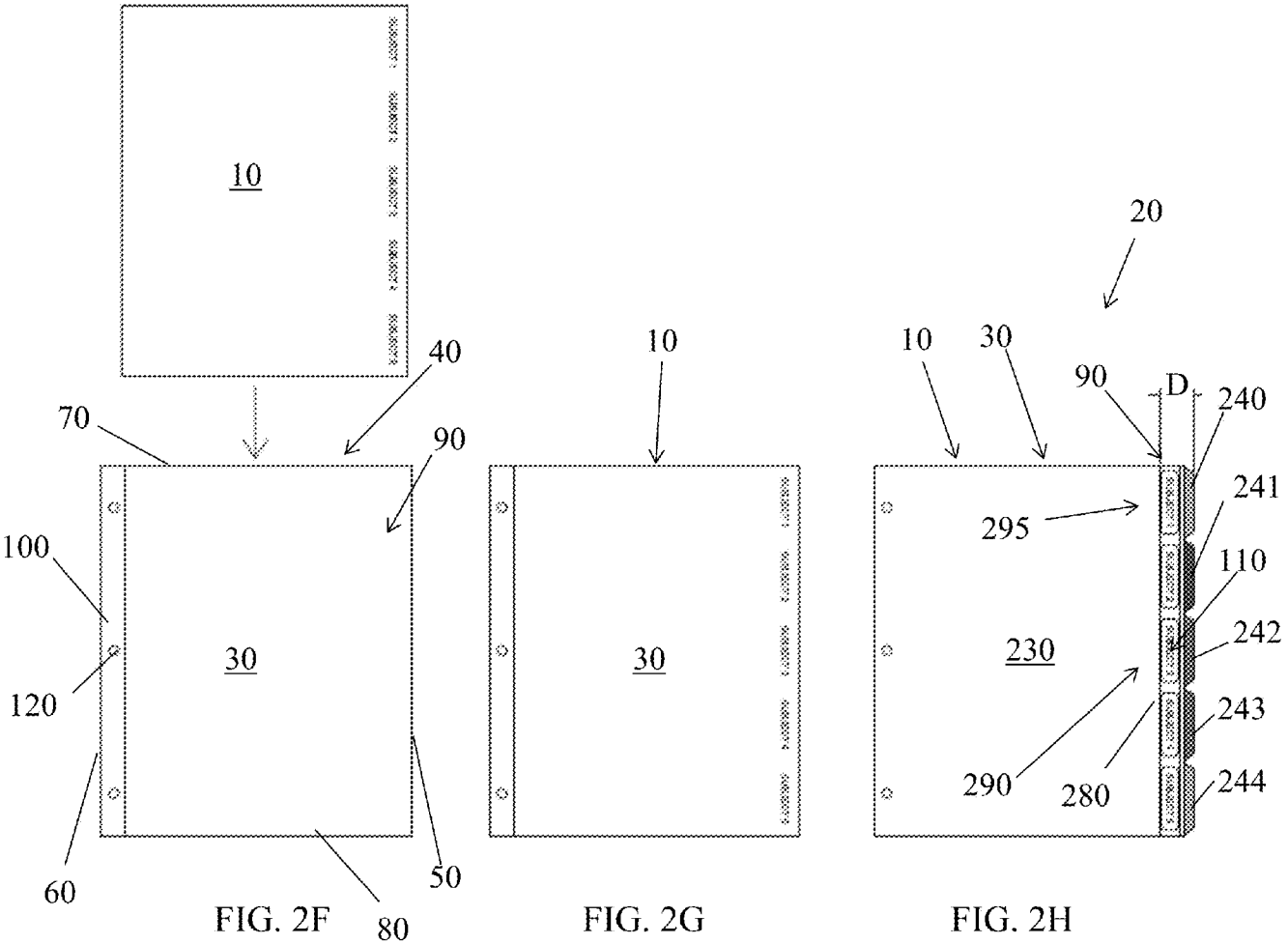
FIG. 2F is a plan view of a sleeve and a sheet of the present disclosure.
FIG. 2G is a plan view of the sheet within the sleeve of FIG. 2F.
FIG. 2H is a plan view of an embodiment of the divider set of FIGS. 2A-2E in alignment with the sheet in accordance with one aspect of the present disclosure.

The dividers 230-234 may each include bodies 250-254, respectively, having an outwardly extending tab that extends along its perimeter. FIGS. 2A-2E illustrates five (5) tabs 240-244 associated with dividers 230-234, respectively. The tabs 240-244 may extend from a perimeter edge 260 of the bodies 250-254 of each divider 230-234 at a different position along the perimeter edge such that when the dividers 230-234 are aligned, the tabs 240-244 are vertically off-set in a known manner, as illustrated by FIG. 2H, for easy viewing, access and manipulation of the dividers 230-234. If many dividers are used to separate different groupings of papers in the system, then a plurality of divider sets (not shown) may also be used. The body 250-254 of each divider may include a plurality of apertures 270 aligned along a side of the divider. The apertures 270 may be positioned on the body 250-254 to allow the dividers 230-234 to be operably attached to a binder or folder (not shown), such as a three ring binder.

The tabs 240-244 may have a generally monolithic continuous configuration with the bodies 250-254 and be formed on the bodies 250-254 of the dividers 230-234 by a die-cutting machine, or other cutting apparatus generally known in the art. Alternatively, the tabs 240-244 may be separate members from the bodies 250-254 and may be attached thereto by an adhesive or other method. The tabs 240-244 may be made of any appropriate material, including, without limitation, paper, plastic, cardboard, or a polymer material such as a polypropylene material. The tabs may be clear or opaque, colored or colorless, transparent, translucent or semi-translucent material and include various combinations of colors. In this embodiment, the bodies 250-254 include a plurality of window apertures 290 that generally aligned with the viewable portion 90 and indicia 110 adjacent the first edge 50 of the sleeve 30. The bodies 250-254 may be clear or semi-translucent material to allow the user to view the indicia 110 along the viewable portion 90 adjacent to the first edge 50 of the sleeve 30. However, the remaining portion of the body 250-254 of the dividers 230-234 may be clear or opaque, colored or colorless, transparent, translucent or semi-translucent material and include various combinations of colors. In this embodiment, the window apertures 290 of the bodies 250-254 are aligned with the plurality of tabs 240-244. As illustrated by FIG. 2A, the divider 230 includes four (4) window apertures 290 that are aligned to allow the user to view the indicia 110 from the sleeve 30 below. The tab 240 may extend from the body 250 adjacent a generally filled portion 295 that does not include a window aperture 290. The generally filled portion 295 may be in alignment with the plurality of window apertures 290 within the viewable portion 90 of the sleeve 30. This configuration may be generally repeated through dividers 231-234 such that each tab 241-244 extends from the bodies 251-254 adjacent a generally filled portion 295 in alignment with the plurality of window apertures 290. In this embodiment, the tab adjacent the generally filled portion may include similar indicia that may be associated with that divider as it is aligned with the sleeve 30.

As illustrated by FIG. 2H, the dividers 230-234 and the sleeve 30 may be combined for dividing various sections within the stack of dividers 230-234. Divider 230 may be positioned on top of the divider system 20 and the sleeve may be positioned at the bottom of the divider system 20 wherein the stack of papers or materials to be divided are positioned between or relative to the associated divider 230-234. In this embodiment, the perimeter edge 260 of the dividers 230-234 may be aligned with the first edge 50 of the sleeve 30 such that the indicia 110 may be positioned inwardly from the plurality of tabs 240-244. The dividers 230-234 may be generally clear or translucent along a portion of the body adjacent the perimeter edge 260 to allow the user to view the indicia 110 through the window apertures 290 of the bodies 250-254 of the dividers 230-234 that are not aligned with the generally filled portion 295. The indicia 110 may include various labels that are associated with and generally aligned and inwardly adjacent to the tabs 240-244. In this embodiment, the stack of papers that are divided by the dividers 230-234 also includes a perimeter edge that would align with or be the located generally inward from an indicia line 280. The indicia line 280 may be located a dimension D from a top of the plurality of tabs 240-244. In one non-limiting embodiment, dimension D is approximately 1 inch.

An additional embodiment of the divider system 20 is illustrated by FIGS. 3A-3E. This embodiment may be similar to the embodiment illustrated by FIGS. 2A-2E but includes window apertures 390 for each divider and indicia label associated with each divider without the generally filled portion 295 aligned with the associated tabs. In this embodiment, there are five (5) dividers 330-334, however this disclosure may include any number of dividers, e.g., two, three, four, six, seven, eight, etc. The dividers 330-334 may be combined with the sleeve 30 and sheet 10.

Figures 3A, 3B, 3C, 3D, 3E:
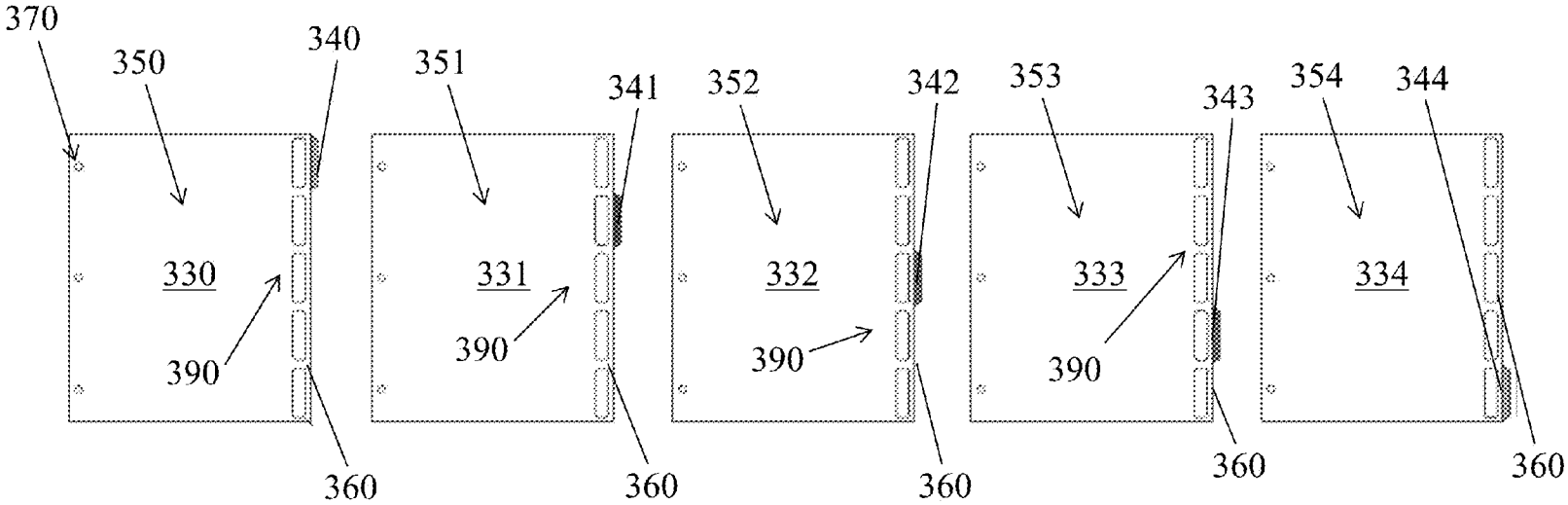
FIG. 3A is a plan view of a divider of a divider set in accordance with an embodiment of the present disclosure.
FIG. 3B is a plan view of a divider of the divider set of the present disclosure.
FIG. 3C is a plan view of a divider of the divider set of the present disclosure.
FIG. 3D is a plan view of a divider of the divider set of the present disclosure.
FIG. 3E is a plan view of a divider of the divider set of the present disclosure.
Figures 3F, 3G, 3H:
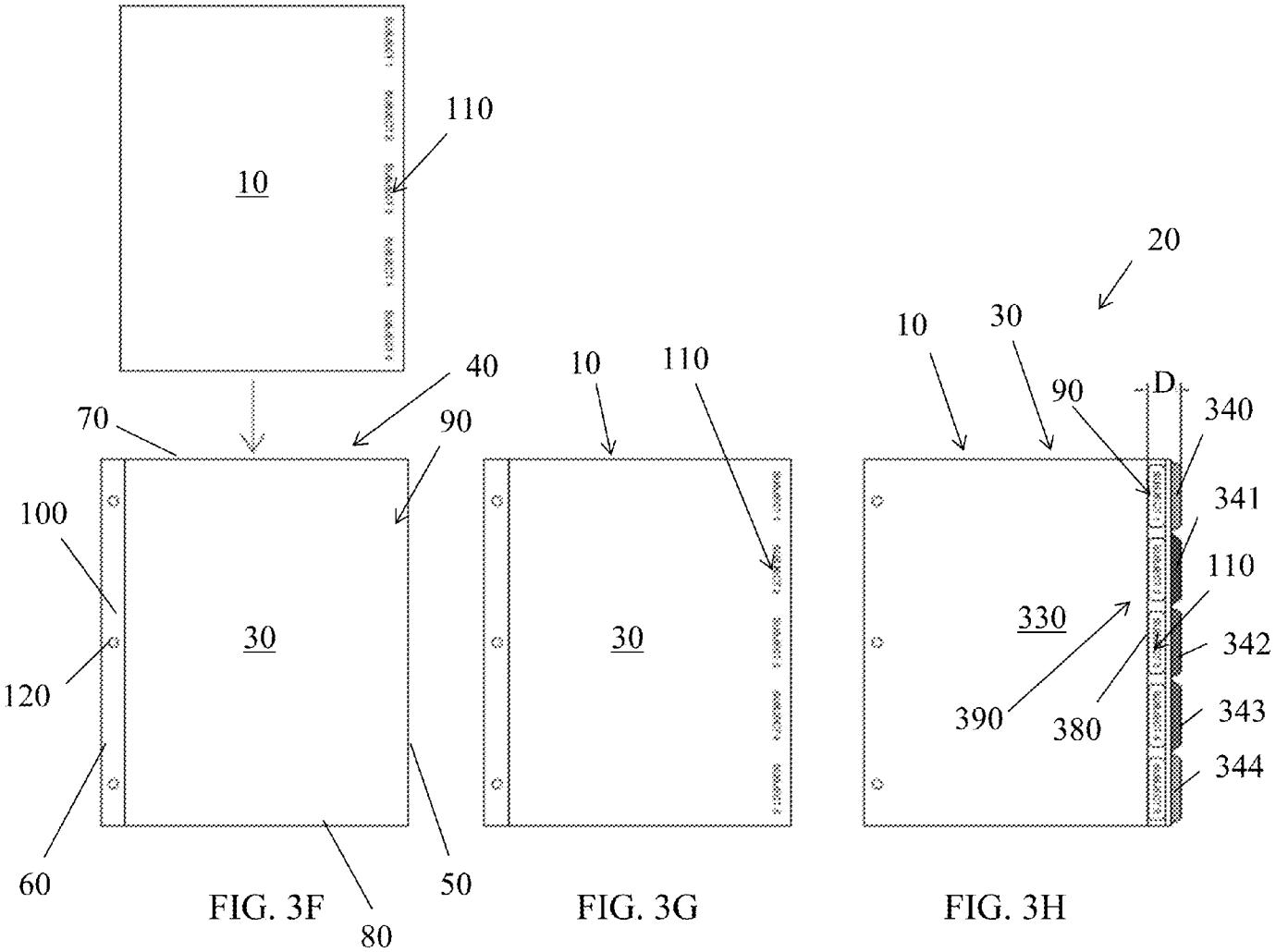
FIG. 3F is a plan view of an embodiment of a sleeve and a sheet of the present disclosure.
FIG. 3G is a plan view of the sheet within the sleeve of FIG. 3F.
FIG. 3H is a plan view of an embodiment of the divider set of FIGS. 3A-3E in alignment with the sheet in accordance with one aspect of the present disclosure.

The dividers 330-334 may each include bodies 350-354, respectively, having an outwardly extending tab that extends along its perimeter. FIGS. 3A-3E illustrates five (5) tabs 340-344 associated with dividers 330-334, respectively. The tabs 340-344 may extend from a perimeter edge 360 of the bodies 350-354 of each divider 330-334 at a different position along the perimeter edge such that when the dividers 330-334 are aligned, the tabs 340-344 are vertically off-set in a known manner, as illustrated by FIG. 3H, for easy viewing, access and manipulation of the dividers 330-334. If many dividers 330-334 are used to separate different groupings of papers in the system, then a plurality of divider sets (not shown) may also be used. The bodies 350-354 of each divider may include a plurality of apertures 370 aligned along a side of the divider. The apertures 370 are positioned on the bodies 350-354 to allow the dividers 330-334 to be operably attached to a binder or folder (not shown), such as a three ring binder.

The tabs 340-344 may have a generally monolithic continuous configuration with the bodies 350-354 and be formed on the bodies 350-354 of the dividers 330-334 by a die-cutting machine, or other cutting apparatus generally known in the art. Alternatively, the tabs 340-344 may be separate members from the bodies 350-354 and may be attached thereto by an adhesive or other method. The tabs 340-344 may be made of any appropriate material, including, without limitation, paper, plastic, cardboard, or a polymer material such as a polypropylene material. The tabs may be clear or opaque, colored or colorless, transparent, translucent or semi-translucent material and include various combinations of colors. In this embodiment, the bodies 350-354 include a plurality of window apertures 390 that generally align with the viewable portion 90 and indicia 110 adjacent the first edge 50 of the sleeve 30. The bodies 350-354 of the dividers 330-334 may be clear or opaque, colored or colorless, transparent, translucent or semi-translucent material and include various combinations of colors. In this embodiment, the window apertures 390 of the bodies 350-354 are aligned with the plurality of tabs 340-344. As illustrated by FIG. 3A, the divider 330 includes five (5) window apertures 390 that are aligned to allow the user to view the indicia 110 from the sleeve 30 below. This configuration may be generally repeated through dividers 331-334 such that each tab 341-344 extends from the bodies 351-354 adjacent a window aperture 390.

As illustrated by FIG. 3H, the dividers 330-334 and the sleeve 30 may be combined for dividing various sections within the stack of dividers 330-334. Divider 330 may be positioned on the top of the divider system 20 and the sleeve may be positioned at the bottom of the divider system 20 wherein the stack of papers or materials to be divided are positioned between or relative to the associated divider 330-334. In this embodiment, the perimeter edge 360 of the dividers 330-334 may be aligned with the first edge 50 of the sleeve 30 such that the indicia 110 may be positioned inwardly from the plurality of tabs 340-344. The window apertures 390 allow the user to view the indicia 110 through the bodies 350-354 of the dividers 330-334. The indicia 110 may include various labels that are associated with and generally aligned and inwardly adjacent to the tabs 340-344. In this embodiment, the stack of papers that are divided by the dividers 330-334 also includes a perimeter edge that would align with or be located generally inward from an indicia line 380. The indicia line 380 may be located a dimension D from a top of the plurality of tabs 340-344. In one non-limiting embodiment, dimension D is approximately 1 inch.

Another embodiment of a divider set is illustrated by FIGS. 4A-4F. In this embodiment, there are five (5) dividers 430-434, however this disclosure may include generally any number of dividers, e.g., two, three, four, six, seven, eight, etc. The dividers 430-434 may be generally combined with the sleeve 30 and sheet 10. The dividers 430-434 may include the same or similar features as discussed in the previous embodiments but is not limited thereto.

Figure 4A:
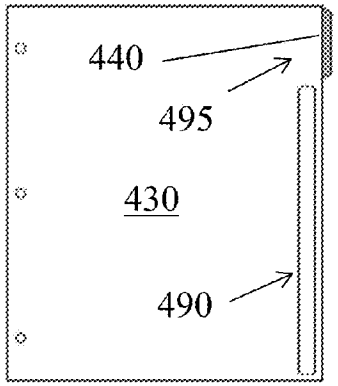
FIG. 4A is a plan view of a divider of a divider set in accordance with an embodiment of the present disclosure.
Figure 4B:
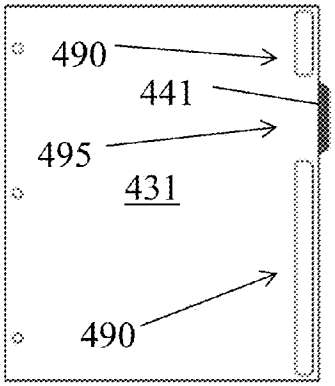
FIG. 4B is a plan view of a divider of the divider set of the present disclosure.
Figure 4C:
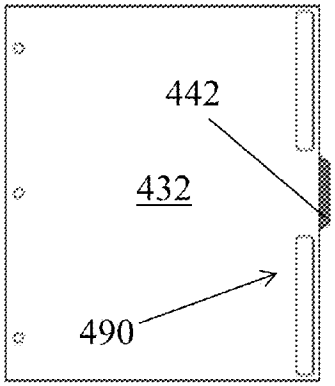
FIG. 4C is a plan view of a divider of the divider set of the present disclosure.
Figure 4D:
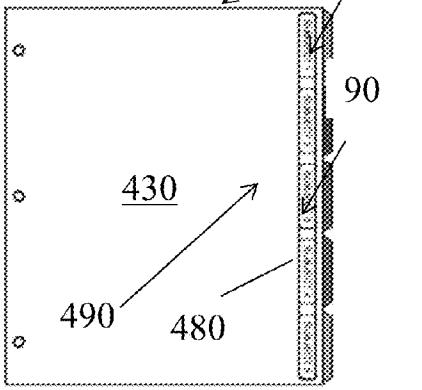
FIG. 4D is a plan view of a divider of the divider set of the present disclosure.
Figure 4E:
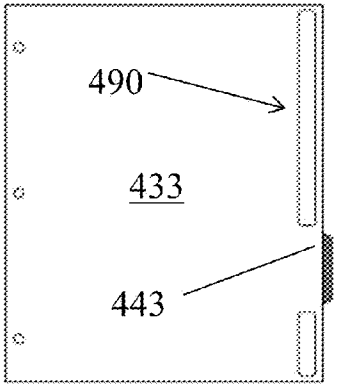
FIG. 4E is a plan view of a divider of the divider set of the present disclosure.
Figure 4F:
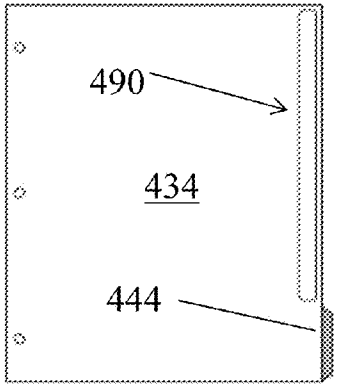
FIG. 4F is a plan view of an embodiment of the divider set of FIGS. 4A-4E in accordance with one aspect of the present disclosure.
Figure 8A:
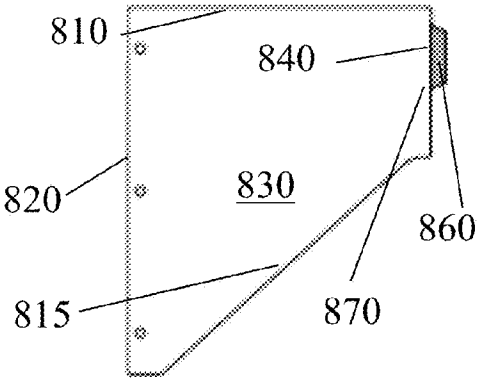
FIG. 8A is a plan view of a divider of a divider set in accordance with an embodiment of the present disclosure.
Figure 8B:
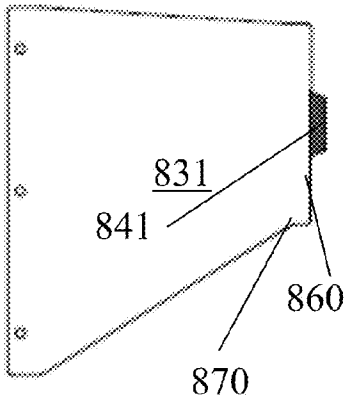
FIG. 8B is a plan view of a divider of the divider set of the present disclosure.
Figure 8C:
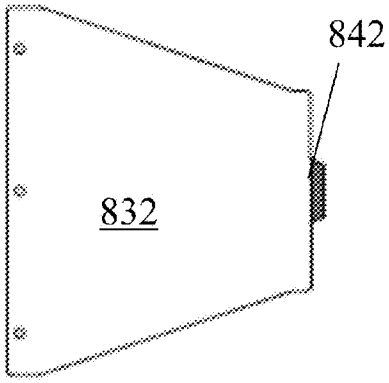
FIG. 8C is a plan view of a divider of the divider set of the present disclosure.
Figure 8D:
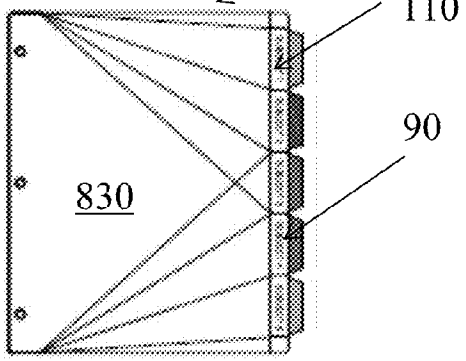
FIG. 8D is a plan view of a divider of the divider set of the present disclosure.
Figure 8E:
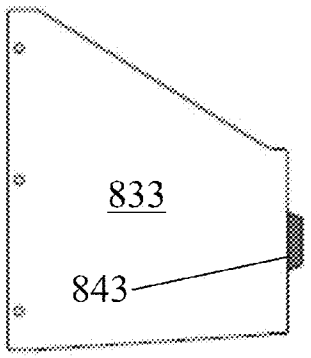
FIG. 8E is a plan view of a divider of the divider set of the present disclosure.
Figure 8F:
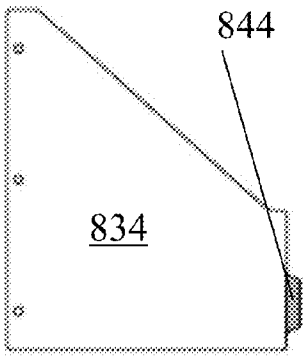
FIG. 8F is a plan view of an embodiment of the divider set of FIGS. 8A-8E in accordance with one aspect of the present disclosure.
Figure 9A:
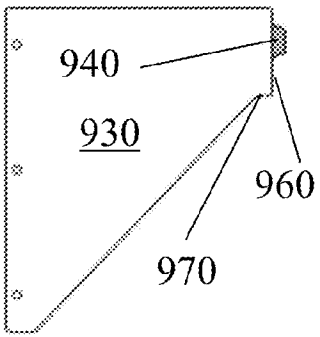
FIG. 9A is a plan view of a divider of a divider set in accordance with an embodiment of the present disclosure.
Figure 9B:
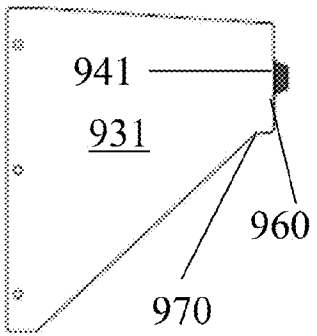
FIG. 9B is a plan view of a divider of the divider set of the present disclosure.
Figure 9C:
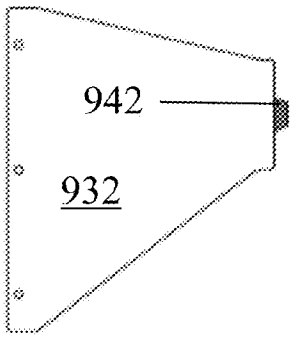
FIG. 9C is a plan view of a divider of the divider set of the present disclosure.
Figure 9D:
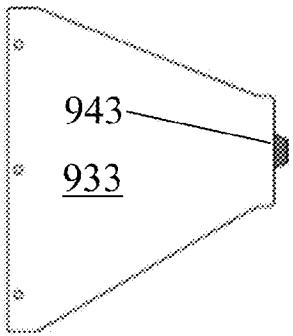
FIG. 9D is a plan view of a divider of the divider set of the present disclosure.
Figure 9E:
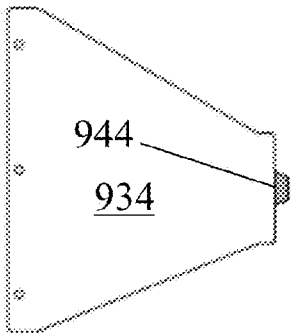
FIG. 9E is a plan view of a divider of the divider set of the present disclosure.
Figure 9F:
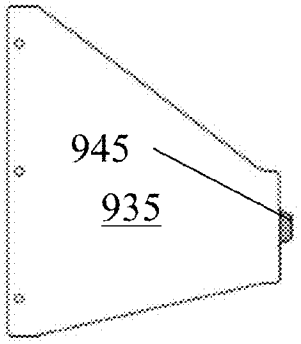
FIG. 9F is a plan view of a divider of a divider set of the present disclosure.
Figure 9G:
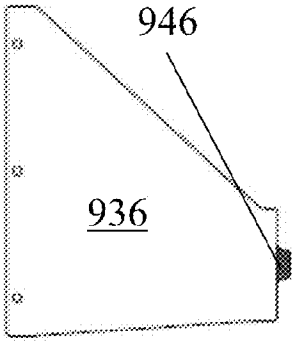
FIG. 9G is a plan view of a divider of the divider set of the present disclosure.
Figure 9H:
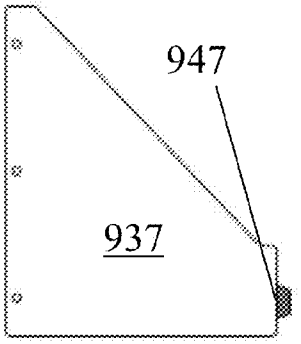
FIG. 9H is a plan view of a divider of the divider set of the present disclosure.
Figure 9I:
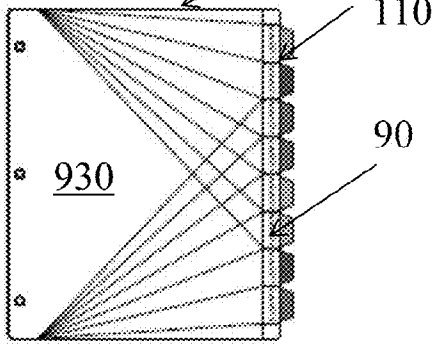
FIG. 9I is a plan view of an embodiment of the divider set of FIGS. 9A-9H in accordance with one aspect of the present disclosure.
Figure 10A:
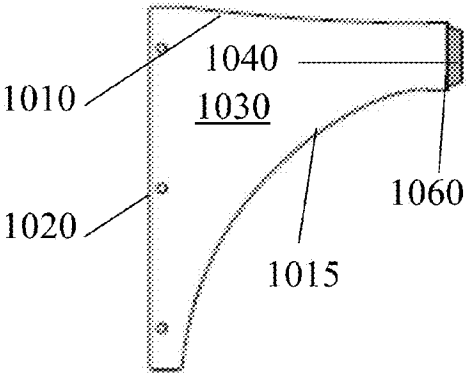
FIG. 10A is a plan view of a divider of a divider set in accordance with an embodiment of the present disclosure.
Figure 10B:
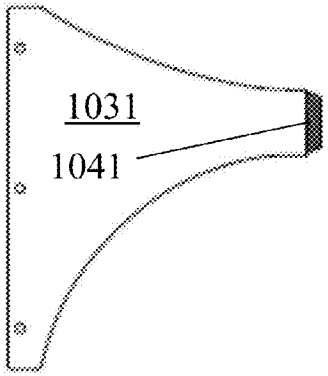
FIG. 10B is a plan view of a divider of the divider set of the present disclosure.
Figure 10C:
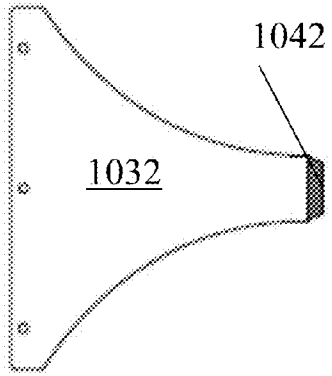
FIG. 10C is a plan view of a divider of the divider set of the present disclosure.
Figure 10D:
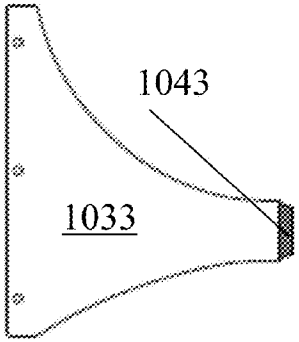
FIG. 10D is a plan view of a divider of the divider set of the present disclosure.
Figure 10E:
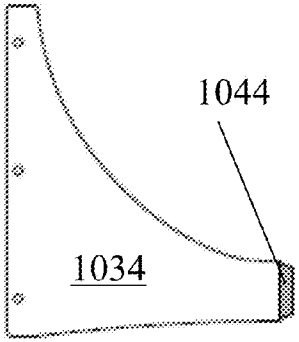
FIG. 10E is a plan view of a divider of the divider set of the present disclosure.
Figure 10F:
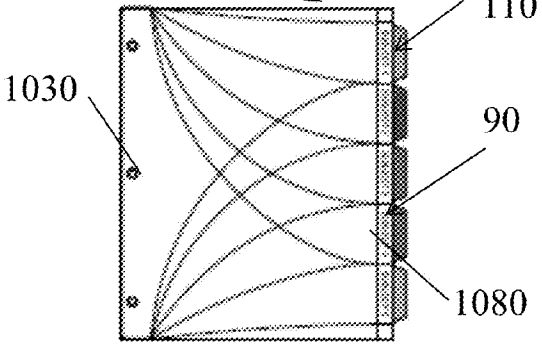
FIG. 10F is a plan view of an embodiment of the divider set of FIGS. 10A-10E in accordance with one aspect of the present disclosure.

The dividers 430-434 may each include bodies having an outwardly extending tab that extends along its perimeter. FIGS. 4A-4F illustrates five (5) tabs 440-444 associated with dividers 430-434, respectively. The tabs 440-444 may extend from a perimeter edge of the bodies of each divider 430-434 at a different position along the perimeter edge such that when the dividers 430-434 are aligned, the tabs 440-444 are vertically off-set in a known manner, as illustrated by FIG. 4F, for easy viewing, access and manipulation of the dividers 430-434. If many dividers are used to separate different groupings of papers in the system, then a plurality of divider sets (not shown) may also be used. In this embodiment, the bodies include a plurality of window apertures 490 that generally align with the viewable portion 90 and indicia 110 adjacent the first edge 50 of the sleeve 30. The bodies of the dividers 430-434 may be clear or semi-translucent material to allow the user to view the indicia 110 along the viewable portion 90 adjacent to the first edge 50 of the sleeve 30. However, the remaining portion of the bodies of the folders may be clear or opaque, colored or colorless, transparent, translucent or semi-translucent material and include various combinations of colors. In this embodiment, the window apertures 490 of the bodies are aligned with the plurality of tabs 440-444. As illustrated by FIG. 4A, the divider 430 includes one (1) elongated window aperture 490 that may be aligned to allow the user to view the indicia 110 from the sleeve 30 below. The tab 440 extends from the body adjacent a generally filled portion 495 that does not include the window aperture 490. The generally filled portion 495 is in alignment with the plurality of window apertures 490 within the viewable portion 90 of the sleeve 30. This configuration may be generally repeated through dividers 431-434 such that each tab 441-444 extends from the bodies adjacent a generally filled portion 495 in alignment with the elongated window aperture(s) 490. For example, divider 431 includes tab 441 that extends along the perimeter thereof in a portion spaced from a top of the divider 431. The tab 441 may be adjacent the generally filled portion 495 and the window aperture 490 may be provided both above and below the generally filled portion 495.

As illustrated by FIG. 4F, the dividers 430-434 and the sleeve 30 may be combined for dividing various sections within the stack of dividers 430-434. Divider 430 may be positioned on the top of the divider system 20 and the sleeve may be positioned at the bottom of the divider system 20 wherein the stack of papers or materials to be divided are positioned between or relative to the associated divider 430-434. In this embodiment, the perimeter edge of the dividers 430-434 may be aligned with the first edge 50 of the sleeve 30 such that the indicia 110 may be positioned inwardly from the plurality of tabs 440-444. The dividers 430-434 may be generally clear or translucent along a portion of the body adjacent a perimeter edge to allow the user to view the indicia 110 through the window apertures 490 of the bodies of the dividers 430-434 that are not aligned with the generally filled portion 495. The indicia 110 may include various labels that are associated with and generally aligned and inwardly adjacent to the tabs 440-444. In this embodiment, the stack of papers that are divided by the dividers also includes a perimeter edge that would align with or be located generally inward from an indicia line 480.

Another embodiment of a divider set is illustrated by FIGS. 5A-5F. In this embodiment, there are five (5) dividers 530-534, however this disclosure may include generally any number of dividers, e.g., two, three, four, six, seven, eight, etc. The dividers 530-534 may be generally combined with the sleeve 30 and sheet 10. The dividers 530-534 may include the same or similar features as discussed in the previous embodiments but is not limited thereto.

The dividers 530-534 may each include bodies having an outwardly extending tab that extends along its perimeter. FIGS. 5A-5F illustrates five (5) tabs 540-544 associated with dividers 530-534, respectively. The tabs 540-544 may extend from a perimeter edge of the bodies of each divider 530-534 at a different position along the perimeter edge such that when the dividers are aligned, the tabs 540-544 are vertically off-set in a known manner, as illustrated by FIG. 5F, for easy viewing, access and manipulation of the dividers 530-534. If many dividers are used to separate different groupings of papers in the system, then a plurality of divider sets (not shown) may also be used. In this embodiment, the bodies include a first side 510 and a second side 515 that extend between a base portion 520 and a perimeter edge 560 of the divider such that the tab aligns with the associated indicia 110 within the viewable portion 90 of the sleeve 30. The bodies of the dividers 530-534 along the viewable portion 90 may be clear, colored or colorless, transparent, translucent or semi-translucent material and include various combinations of colors. The remaining portion of the bodies may be opaque. In this embodiment, the first side 510 and second side 515 of the bodies are aligned with the plurality of tabs 540-544. As illustrated by FIG. 5A, the first side 510 is generally straight and transverse between the base portion 520 and the perimeter edge 560 while the second side 515 is angled relative to the location of the tab 540 with a generally straight orientation. This configuration aligns the tab 540 and perimeter edge with the indicia 110 and indicia line 580 such that the user may view the indicia associated with tab 540 through the divider 530 along viewable portion 90 from the sleeve 30 below. This configuration is generally repeated through dividers 531-534 such that the first and second sides 510 and 515 associated with each of the tabs 541-544 extend from the base portions 520 to the relative position of each respective tab along the perimeter edge 560 in alignment with the indicia 110 and indicia line 580. For example, divider 531 includes the first side 510 and the second side 515 that each extend from the base portion 520 in a relatively straight and angled configuration to the tab 541 that is aligned and vertically offset to subsequent tab 540. For example, the dividers 531-534 may be generally hexagonal or pentagonal, i.e., they may possess a relatively vertical base portion 520 and perimeter edge 560. The first side 510 may either be generally horizontal or a portion thereof may be horizontal with a portion that is angled downward toward the perimeter edge 560. The second side 515 may either be generally horizontal or a portion thereof may be horizontal with a portion that is angled upward toward the perimeter edge 560.

As illustrated by FIG. 5F, the dividers 530-534 and the sleeve 30 may be combined for dividing various sections within the stack of dividers 530-534. Divider 530 may be positioned on the top of the divider system 20 and the sleeve may be positioned at the bottom of the divider system 20 wherein the stack of papers or materials to be divided are positioned between or relative to the associated divider 530-534. In this embodiment, the perimeter edge of the dividers 530-534 may be aligned with the first edge 50 of the sleeve 30 such that the indicia 110 is positioned inwardly from the plurality of tabs 540-544. The dividers 530-534 may be generally clear or translucent along a portion of the body adjacent the perimeter edge 560 to allow the user to view the indicia 110 through the bodies of the dividers 530-534. The shape of the dividers 530-534 may generally prevent or limit the amount of the adjacent divider that sits on top of the divider—it limits the amount of material stacked on top of one another. This may prevent a build up of the dividers 530-534, which may improve the visibility of the indicia 110. In current systems, despite the dividers being clear if a plurality of dividers is stacked on top of each other, the indicia below may become blurry or otherwise more difficult to view. The indicia 110 may include various labels that are associated with and generally aligned and inwardly adjacent to the tabs 540-544. In this embodiment, the stack of papers that are divided by the dividers 530-534 also includes a perimeter edge that would align with or be located generally inward from an indicia line 580.

Another embodiment of a divider set is illustrated by FIGS. 6A-6F. In this embodiment, there are five (5) dividers 630-634, however this disclosure may include generally any number of dividers, e.g., two, three, four, six, seven, eight, etc. The dividers 630-634 may be generally combined with the sleeve 30 and sheet 10. The dividers 630-634 may include the same or similar features as discussed in the previous embodiments but is not limited thereto.

The dividers 630-634 may each include bodies having an outwardly extending tab that extends along its perimeter. FIGS. 6A-6F illustrates five (5) tabs 640-644 associated with dividers 630-634, respectively. The tabs 640-644 may extend from a perimeter edge 660 of the bodies of each divider 630-634 at a different position along the perimeter edge such that when the dividers 630-634 are aligned, the tabs 640-644 are vertically off-set in a known manner, as illustrated by FIG. 6F, for easy viewing, access and manipulation of the dividers. If many dividers are used to separate different groupings of papers in the system, then a plurality of divider sets (not shown) may also be used. In this embodiment, the bodies include a first side 610 and a second side 615 that extend between a base portion 620 and a lateral portion 670 extending from the perimeter edge 660 of the divider such that the tab aligns with the associated indicia 110 within the viewable portion 90 of the sleeve 30. In this embodiment, the user is able to view the indicia 110 through the lateral portion 670 of the dividers 630-634. The bodies of the dividers 630-634 along the viewable portion 90 may be clear, colored or colorless, transparent, translucent or semi-translucent material and include various combinations of colors. The remaining portion of the bodies may be opaque. In this embodiment, the first side 610 and second side 615 of the bodies are aligned with the plurality of tabs 640-644. As illustrated by FIG. 6A, the first side 610 is shaped generally 90 degrees between the base portion 620 and the perimeter edge 660 while the second side 615 is angled relative to the location of the tab 640 with a generally straight edge. The second side 615 extends between the base portion 620 and the lateral portion 670 which extends from the perimeter edge 660. This configuration aligns the tab 640, perimeter edge 660 and lateral portion 670 with the indicia 110 and indicia line 680 such that the user may view the indicia associated with tab 640 through the lateral portion 670 of the divider 630 along viewable portion 90 from the sleeve 30 below. This configuration is generally repeated through dividers 631-634 such that the first and second sides 610 and 615 associated with each of the tabs 641-644 extend from the base portions 620 to the relative position of each respective lateral portion 670 of each tab along the perimeter edge 660 in alignment with the indicia 110 and indicia line 680. For example, divider 631 includes the first side 610 and the second side 615 that each extend from the base portion 620 in a relatively straight and angled configuration. In this embodiment, the lateral portion 670 and perimeter edge 660 extend the approximate length of a single tab for each divider.

As illustrated by FIG. 6F, the dividers 630-634 and the sleeve 30 may be combined for dividing various sections within the stack of dividers 630-634. Divider 630 may be positioned on the top of the divider system 20 and the sleeve may be positioned at the bottom of the divider system 20 wherein the stack of papers or materials to be divided are positioned between or relative to the associated divider 630-634. In this embodiment, the perimeter edge 660 of the dividers 630-634 may be aligned with the first edge 50 of the sleeve 30 such that the indicia 110 is positioned inwardly from the plurality of tabs 640-644. The dividers 630-634 may be generally clear or translucent along a portion of the body adjacent the perimeter edge 660 to allow the user to view the indicia 110 through the bodies of the dividers 630-634. The shape of the dividers 630-634 may generally prevent or limit the amount of the adjacent divider that sits on top of the divider—it limits the amount of material stacked on top of one another. This may prevent a build up of the dividers 630-634, which may improve the visibility of the indicia 110. In current systems, despite the dividers being clear if a plurality of dividers is stacked on top of each other, the indicia below may become blurry or otherwise more difficult to view. The indicia 110 may include various labels that are associated with and generally aligned and inwardly adjacent to the tabs 640-644. In this embodiment, the stack of papers that are divided by the dividers also includes a perimeter edge that would align with or be located generally inward from an indicia line 680.

Another embodiment of a divider set is illustrated by FIGS. 7A-7F. In this embodiment, there are five (5) dividers 730-734, however this disclosure may include generally any number of dividers, e.g., two, three, four, six, seven, eight, etc. The dividers 730-734 may be similar in many respects to dividers 630-634. However, dividers 731, 732 and 733 may include a lateral portion 770 that extends a length that is greater than a length of the tabs along the perimeter edge 760. This orientation allows the user to view various indicia through the dividers 731, 732, and 733 including indicia associated with either the previous divider or the subsequent divider. The shape of the dividers 730-734 may generally prevent or limit the amount of the adjacent divider that sits on top of the divider—it limits the amount of material stacked on top of one another. This may prevent a build up of the dividers 730-734, which may improve the visibility of the indicia 110. In current systems, despite the dividers being clear if a plurality of dividers is stacked on top of each other, the indicia below may become blurry or otherwise more difficult to view.

Another embodiment of a divider set is illustrated by FIGS. 8A-8F. In this embodiment, there are five (5) dividers 830-834, however this disclosure may include generally any number of dividers. The dividers 830-834 may be similar in many respects to dividers 630-634 and 730-734. However, dividers 830, and 834 may include a lateral portion 870 and perimeter edge 860 that extend a first length that is greater than a length of the tabs. Dividers 831, 832, and 833 may include a lateral portion 870 and perimeter edge 860 that extends a second length that is greater than the first length and may include having a tab extending from a midway portion of the perimeter edge 860. This orientation allows the user to view various indicia through the dividers 830-834 including indicia associated with either the previous divider or the subsequent divider. The shape of the dividers 830-834 may generally prevent or limit the amount of the adjacent divider that sits on top of the divider—it limits the amount of material stacked on top of one another. This may prevent a build up of the dividers 830-834, which may improve the visibility of the indicia 110. In current systems, despite the dividers being clear if a plurality of dividers is stacked on top of each other, the indicia below may become blurry or otherwise more difficult to view.

Another embodiment of a divider set is illustrated by FIGS. 9A-9I. In this embodiment, there are eight (8) dividers 930-937, however this disclosure may include generally any number of dividers. The dividers 930-937 may be similar in many respects to dividers 630-634, 730-734, and 830-834. Dividers 930, and 937 include a lateral portion 970 and perimeter edge 960 that extend a first length that is greater than a length of the tabs. Dividers 931, 932, 933, 934, 935, and 936 may include a lateral portion 970 and perimeter edge 960 that extend a second length that is greater than the first length and may include having a tab extending from a midway portion of the perimeter edge 960. This orientation allows the user to view various indicia through the dividers 930-937 including indicia associated with either a plurality of previous dividers or a plurality of subsequent dividers. The shape of the dividers 930-937 may generally prevent or limit the amount of the adjacent divider that sits on top of the divider—it limits the amount of material stacked on top of one another. This may prevent a build up of the dividers 930-937, which may improve the visibility of the indicia 110. In current systems, despite the dividers being clear if a plurality of dividers is stacked on top of each other, the indicia below may become blurry or otherwise more difficult to view.

Another embodiment of a divider set is illustrated by FIGS. 10A-10F. In this embodiment, there are five (5) dividers 1030-1034, however this disclosure may include generally any number of dividers. The dividers 1030-1034 may be similar in many respects to dividers 630-634, 730-734, and 830-834. Dividers 1030-1034 include a first side 1010 and a second side 1015 that extend between a base portion 1020 and a perimeter edge 1060. Tabs 1040-1044 extend from the perimeter edge 1060 of the dividers. In this embodiment, the first side 1010 and second side 1015 include a generally curved orientation as they extend between the base portion 1020 and the perimeter edge 1060. This configuration aligns the tabs 1040-1044 and perimeter edges with the indicia 110 and indicia line 1080 such that the user may view the indicia 110 associated with each tab through the respective divider along viewable portion 90 from the sleeve 30 below. This configuration is generally repeated through dividers 1031-1034 such that the first and second sides 1010 and 1015 associated with each of the tabs 1041-1044 extend from the base portions 1020 to the relative position of each respective tab along the perimeter edge 1060 in alignment with the indicia 110 and indicia line 1080. For example, divider 1031 includes the first side 1010 having a more pronounced curvature than divider 1030 and the second side 1015 having a relatively less pronounced curvature relative to divider 1030—although the opposite may apply for some embodiments. In this embodiment, the user is able to view the indicia 110 through the body of the dividers 1030-1034. The shape of the dividers 1030-1034 may generally prevent or limit the amount of the adjacent divider that sits on top of the divider—it limits the amount of material stacked on top of one another. This may prevent a build up of the dividers 1030-1034, which may improve the visibility of the indicia 110. In current systems, despite the dividers being clear if a plurality of dividers is stacked on top of each other, the indicia below may become blurry or otherwise more difficult to view.

Another embodiment of a divider set is illustrated by FIGS. 11A-11F. In this embodiment, there are five (5) dividers 1130-1134, however this disclosure may include generally any number of dividers. The dividers 1130-1134 may be similar in many respects to dividers 1030-1034. Dividers 1130-1134 may include an enlarged base portion 1120 having a first base edge 1122 and a second base edge 1124. A first side 1110 extends between the first base edge 1122 and a perimeter edge 1160. A second side 1115 extends between the second base edge 1124 and the perimeter edge 1060. Tabs 1140-1144 extend from the perimeter edge 1160 of the dividers. In this embodiment, the first side 1110 and second side 1115 include a generally curved orientation as they extend between the first and second base edges 1122, 1124, respectively, of the base portion 1020 and the perimeter edge 1060. This configuration aligns the tabs 1140-1144 and perimeter edges with the indicia 110 and indicia line 1080 such that the user may view the indicia associated with each tab through the respective divider along viewable portion 90 from the sleeve 30 below. This configuration may be generally repeated through dividers 1131-1134 such that the first and second sides 1110 and 1115 associated with each of the tabs 1141-1144 extend from the first and second base edges 1122, 1124 of base portion 1120 to the relative position of each respective tab along the perimeter edge 1160 in alignment with the indicia 110 and indicia line 1180. For example, divider 1131 includes the first side 1110 having a more pronounced curvature relative to divider 1130 and the second side 1115 having a less pronounced curvature relative to divider 1130—although the opposite may apply. In this embodiment, the user may be able to view the indicia 110 through the body of the dividers 1130-1134. The shape of the dividers 1130-1134 may generally prevent or limit the amount of the adjacent divider that sits on top of the divider—it limits the amount of material stacked on top of one another. This may prevent a build up of the dividers 1130-1134, which may improve the visibility of the indicia 110. In current systems, despite the dividers being clear if a plurality of dividers is stacked on top of each other, the indicia below may become blurry or otherwise more difficult to view.

Another embodiment of a divider set is illustrated by FIGS. 12A-12I. In this embodiment, there are eight (8) dividers 1230-1237, however this disclosure may include generally any number of dividers. The dividers 1230-1237 may be similar in many respects to dividers 630-634, 730-734, 830-834, and 930-937. Dividers 1230, 1231, 1232, and 1233 include a lateral portion 1270 and perimeter edge 1260 that define a first portion 1240 of the dividers that extend passed the viewable portion 90 of the sleeve 30. Tabs 1240, 1241, 1242, and 1243 may be positioned in staggered alignment along the perimeter edge 1260 of dividers 1230-1233, respectively. Dividers 1234, 1235, 1236, and 1237 include a lateral portion 1280 and perimeter edge 1290 that define a second portion 1250 of the dividers that extend passed the viewable portion 90 of the sleeve 30. Tabs 1244, 1245, 1246, and 1247 may be positioned in staggered alignment along the perimeter edge 1290 of dividers 1234-1237, respectively. This orientation allows the user to view various indicia through the first portion 1220 of dividers 1230-1233 and the second portion 1250 of dividers 1234-1237 wherein the various indicia 110 may be aligned with and relate to a particular tab and divider. The lateral portions 1270 and 1280 may be generally aligned along a midpoint of the dividers and may extend from the base of the dividers at an angle. Lateral portion 1270 may extend from an opposite angle from the divider base as lateral portion 1280 such that the first portion 1220 may be positioned along a top portion of the dividers and the second portion 1250 may be positioned along a bottom portion of the dividers. The first portion 1220 and second portion 1250 may include a generally similar but opposite shapes.

The indicia 110 may be associated with either a plurality of previous dividers or a plurality of subsequent dividers. The shape of the dividers 1230-1237 may generally prevent or limit the amount of the adjacent divider that sits on top of the divider—such that it may limit the amount of material stacked on top of one another. This may prevent a build up of the dividers 1230-1237, which may improve the visibility of the indicia 110. In current systems, despite the dividers being clear if a plurality of dividers is stacked on top of each other, the indicia below may become blurry or otherwise more difficult to view.

Figure 13B:
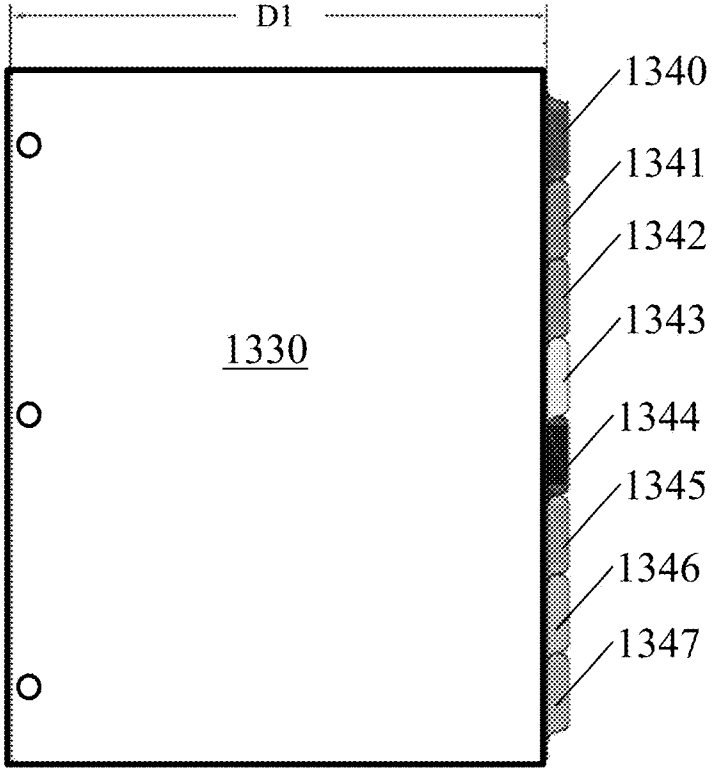
FIG. 13B is a plan view of an embodiment of a divider set of the present disclosure.
Figure 13A:
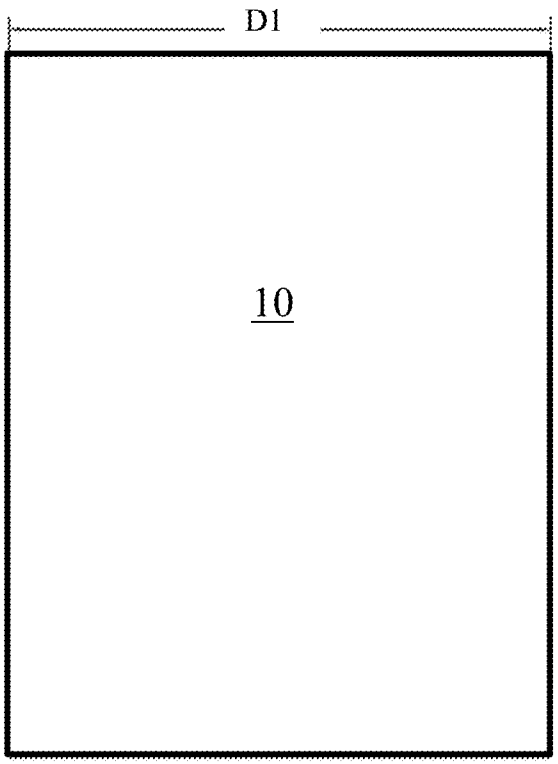
FIG. 13A is a plan view of a sheet in accordance with an embodiment of the present disclosure.
Figure 13D:
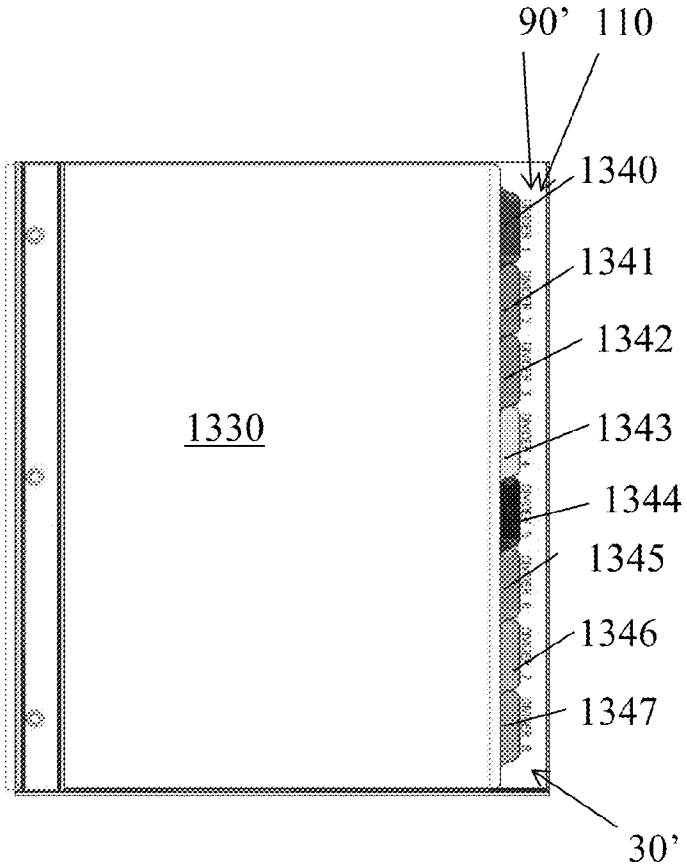
FIG. 13D is a plan view of a sleeve in accordance with an embodiment of the present disclosure.
Figure 13C:
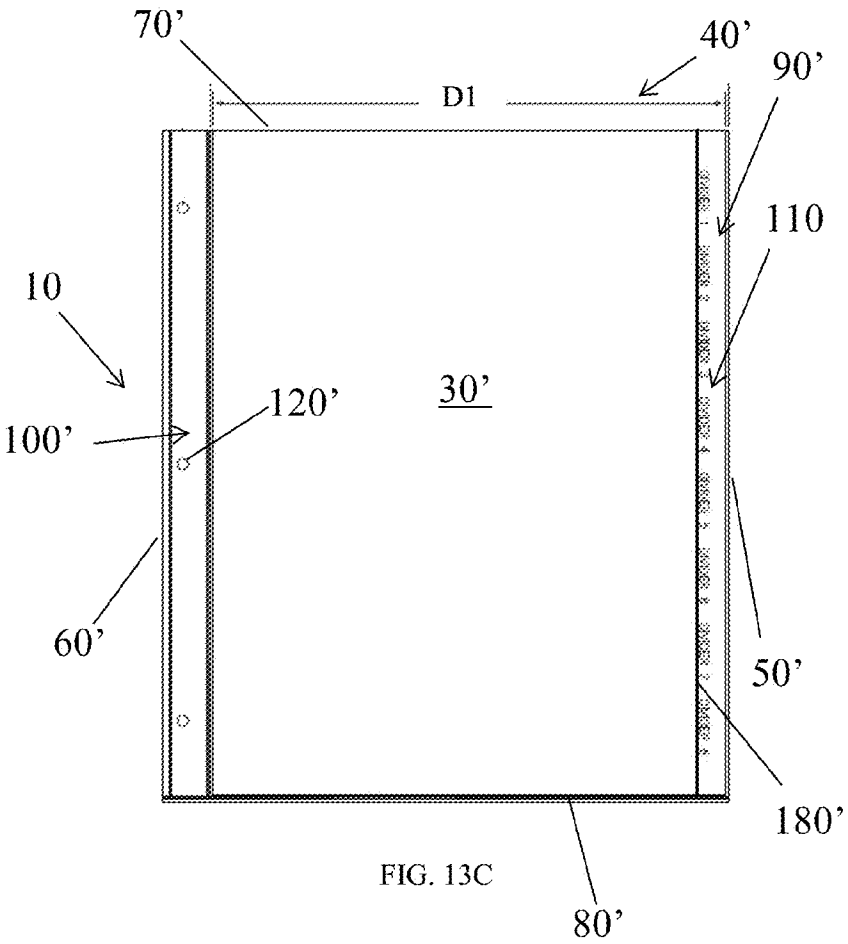
FIG. 13C is a plan view of a divider of the divider set of the present disclosure.

Another embodiment of a divider set is illustrated by FIGS. 13A-13D. In this embodiment, the label sheet 10 is illustrated in FIG. 13A. The dividers 1330 and tabs 1340-1347 are illustrated by FIG. 13B. FIG. 13C illustrates an embodiment of the label display element including the label sheet 10 configured to be inserted within a sleeve 30' that may be made of any appropriate material, including, without limitation a plastic or polymer material such as a polypropylene material or other transparent, translucent or semi-translucent material. As way of a further embodiment, the sleeve 30' may also be formed from a monolithic plastic piece. The sleeve 30' may be shaped to include a pocket 40' to hold the label sheet 10 or other items (such as writing instruments, rulers, paper clips, etc.). It should be understood that the sleeve 30' may be of any appropriate construction and is not limited to that shown and described herein. The sleeve 30' may also include a first edge 50' opposite a second edge 60' and a top edge 70' opposite a bottom edge 80'. The respective edges 50', 60', 70', 80' define a perimeter of the sleeve 30'. In FIG. 13C, the label sheet 10 includes indicia 110 while there is no indicia illustrated on the label sheet 10 of FIG. 13A.

The sleeve 30' may include a viewable portion 90' and a base portion 100'. The viewable portion 90' may extend along the first edge 50' and be configured such that indicia 110 on the label sheet 10 may be aligned with the viewable portion 90' of the sleeve 30'. The indicia 110 may be printed on the label sheet 10 and inserted within the pocket 40' of the sleeve 30'. The indicia 110 may be configured to align along the first edge 50' of the sleeve 30' when the label sheet 10 is inserted into the sleeve 30'. Alternatively, the indicia 110 may be printed directly on the sleeve 30'. Further, the label display element may include the sheet 10 without the sleeve having indicia on a viewable portion thereon.

The sleeve 30' may be shaped to maintain the indicia 110 of the label sheet 10 aligned within the viewable portion 90'. In FIG. 13C-13D, eight (8) separate indicia 110 are illustrated by the Figures and may be viewable along the viewable portion 90' of the sleeve 30'. However, any number of indicia 110 may be provided along the viewable portion 90' of the sleeve 30' and this disclosure is not limited as to number or type. It is contemplated that a broad range of customizable indicia 110 may be viewable to the user along the sheet 10 aligned with the viewable portion 90' of the sleeve 30'.

In embodiments of the sleeve 30', the base portion 100' may include a structural portion that extends inwardly from the second edge 60' and includes a plurality of apertures 120' thereon. The base portion 100' of the sleeve may abut against a side of the label sheet 10, opposite from the indicia 110 such that the indicia 110 may maintain its alignment adjacent the first edge 50' of the sleeve 30' and be aligned with the viewable portion 90'. The base portion 100' assists to provide structural integrity to the apertures 120' of the sleeve 30' as it is attached to a binder or folder. The apertures 120' may be of any configuration and is not limited to that shown and described herein.

In this embodiment, eight separate dividers 1330 and associated tabs 1340-1347 are provided in a stacked and staggered orientation. Once the dividers 1330 are stacked and aligned with the sleeve 30', the indicia 110 associated with the particular divider 1330 and tab 1340-1347 may be aligned with and extends passed the edges of the tabs 1340-1347.

The dividers 1330 may be positioned on the top of the divider system and the sleeve 30' may be positioned at the bottom of the divider system wherein the stack of papers or materials to be divided are positioned between or relative to the associated dividers 1330. In this embodiment, the top edges of tabs 1340-1347 may be aligned with the indicia line 180' of the sleeve 30' such that the indicia 110 may be positioned outwardly from the plurality of tabs 1340-1347. The dividers 1330 may be generally opaque, clear, colored, colorless, or translucent along its entire structure. The user may be able to view the indicia 110 positioned outwardly from the tabs 1340-1347. The indicia 110 may include various labels that are associated with and generally aligned and outwardly adjacent to the tabs 1340-1347. In this embodiment, the stack of papers that are divided by the dividers also includes a perimeter edge that may align with or may be located generally inward from the outer edge of dividers 1330. The indicia line 180' may be located in alignment with a top edge of the plurality of tabs 1340-1347. The space defined between the indicia line 180' and the first edge 50' may be considered to viewable portion 90'. The position of the viewable portion 90' of the sleeve 30' extends passed the top edge of the plurality of tabs 1340-1347 as the dividers 1330 and sleeve 30 are aligned along the second edge 60', the top edge 70' and the bottom edge 80'. The indicia line 180' may be a reference line to identify the alignment of the indicia 110 relative to the sleeve 30' and tabs wherein the indicia line 180' may not necessarily be physically present on the sleeve 30', sheet 10 or label display element.

The label sheet 10 and dividers 1330 may include a dimension D1. The pocket 40' of the sleeve 30' may shaped to receive the label sheet 10 of dimension D1 therein while allowing the indicia 110 to extend passed the tabs 1340-1347 as the sleeve 30' is aligned with the dividers 1330. In one embodiment, dimension D1 is 8.5". The dividers 1330 may be shaped with a similar dimension D1.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The features of each embodiment described and shown herein may be combined with the features of the other embodiments described herein. The claims as follows are intended to include all modifications and alterations insofar as they come within the scope of the claims or the equivalent thereof.

Having thus described the invention, we claim:

1. A divider assembly for dividing a stack of sheets, the divider assembly comprising:

a sleeve having a first edge and an opposite second edge;

a label display element inserted into the sleeve having at least one label indicia generally aligned along the first edge of the sleeve; and at least one divider having a first edge and an opposite second edge and a tab extending from the first edge, a viewable portion positioned within a body of the divider wherein the tab extends beyond the at least one label indicia within the sleeve such that a user can view the at least one label indicia through said viewable portion of the at least one divider.

2. The divider assembly according to claim 1, wherein the sleeve is made of a generally see-through material.

3. The divider assembly according to claim 1, wherein the viewable portion positioned within the body of the at least one divider includes at least one window aperture aligned along the first edge, the window aperture configured to align with the at least one label indicia.

4. The divider assembly according to claim 1, wherein the label display element includes five label indicia configured to align with the tabs of five dividers.

5. The divider assembly according to claim 1, wherein the tab of the divider is aligned with the at least one label indicia within the sleeve.

6. The divider assembly according to claim 1, wherein the tab is opaque.

* * * * *